US011084682B2

(12) United States Patent
Watanabe et al.

(10) Patent No.: US 11,084,682 B2
(45) Date of Patent: Aug. 10, 2021

(54) SHEET PROCESSING APPARATUS AND IMAGE FORMING SYSTEM

(71) Applicants: Takahiro Watanabe, Kanagawa (JP); Tomohiro Furuhashi, Kanagawa (JP); Michitaka Suzuki, Kanagawa (JP); Tomomichi Hoshino, Kanagawa (JP); Yuji Suzuki, Kanagawa (JP); Satoshi Saito, Kanagawa (JP); Takao Watanabe, Kanagawa (JP)

(72) Inventors: Takahiro Watanabe, Kanagawa (JP); Tomohiro Furuhashi, Kanagawa (JP); Michitaka Suzuki, Kanagawa (JP); Tomomichi Hoshino, Kanagawa (JP); Yuji Suzuki, Kanagawa (JP); Satoshi Saito, Kanagawa (JP); Takao Watanabe, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 141 days.

(21) Appl. No.: 16/127,554

(22) Filed: Sep. 11, 2018

(65) Prior Publication Data

US 2019/0010011 A1 Jan. 10, 2019

Related U.S. Application Data

(63) Continuation of application No. 14/838,890, filed on Aug. 28, 2015, now Pat. No. 10,106,364.

(30) Foreign Application Priority Data

Sep. 3, 2014 (JP) ..... 2014-179533
Jun. 22, 2015 (JP) ..... 2015-124860

(51) Int. Cl.
*B65H 45/20* (2006.01)
*B65H 45/101* (2006.01)
(Continued)

(52) U.S. Cl.
CPC ..... *B65H 45/20* (2013.01); *B65H 45/101* (2013.01); *B65H 45/14* (2013.01);
(Continued)

(58) Field of Classification Search
None
See application file for complete search history.

(56) References Cited

U.S. PATENT DOCUMENTS 2,246,336 A * 6/1941 Wyrick ..... B65H 45/20 270/39.05
5,855,730 A * 1/1999 Brusehaber ..... B31F 1/10 118/256
(Continued)

FOREIGN PATENT DOCUMENTS

JP H01-111662 U 7/1989
JP 7309525 A 11/1995
(Continued)

OTHER PUBLICATIONS

Japanese Office Action dated Mar. 19, 2019 for corresponding Japanese Application No. 2015-124860.

*Primary Examiner* — Hemant Desai
*Assistant Examiner* — Tanzim Imam
(74) *Attorney, Agent, or Firm* — Harness, Dickey & Pierce, P.L.C.

(57) ABSTRACT

A sheet processing apparatus includes: a second conveying roller pair that receives and conveys a sheet conveyed by a first conveying roller pair; a first folding roller pair that forms a first fold on the sheet; and a first rotation unit capable of rotating the second conveying roller pair and the first folding roller pair. One roller of the second conveying roller pair and one roller of the first folding roller pair are a common roller shared therebetween. The second conveying roller pair causes the sheet to be deflected and guided to the first folding roller pair, and the first folding roller pair forms
(Continued)

the first fold on the deflected sheet by rotating the first rotation unit in a certain direction in a state in which the sheet is held by the first conveying roller pair and the second conveying roller pair.

17 Claims, 28 Drawing Sheets

(51) Int. Cl.
*B65H 45/14* (2006.01)
*G03G 15/00* (2006.01)
*G03G 21/16* (2006.01)

(52) U.S. Cl.
CPC ..... *G03G 15/6582* (2013.01); *G03G 21/1638* (2013.01); *B65H 2801/27* (2013.01); *G03G 15/70* (2013.01); *G03G 2215/00877* (2013.01)

(56) References Cited

U.S. PATENT DOCUMENTS 9,016,679 B2 4/2015 Kunieda et al.
9,102,117 B2 8/2015 Suzuki et al.
9,212,020 B2 12/2015 Nakada et al.
9,221,647 B2 12/2015 Furuhashi et al.
9,334,140 B2 5/2016 Watanabe et al.
9,388,015 B2 7/2016 Suzuki et al.
2005/0092440 A1* 5/2005 Lindsay ..... B65H 45/144 156/442.1
2009/0057978 A1* 3/2009 Maeda ..... B65H 31/10 270/37
2011/0074081 A1* 3/2011 Hirabayashi ..... B65H 37/04 270/58.12
2012/0205853 A1* 8/2012 Nakamura ..... G03G 15/6538 270/58.01
2012/0313309 A1* 12/2012 Yoshida ..... B65H 31/02 270/58.11
2013/0001848 A1* 1/2013 Hidaka ..... B65H 5/023 270/58.17
2014/0141956 A1* 5/2014 Suzuki ..... B65H 45/14 493/454
2014/0147184 A1 5/2014 Kunieda et al.
2014/0171283 A1 6/2014 Furuhashi et al.
2014/0179504 A1 6/2014 Nakada et al.
2014/0294406 A1* 10/2014 Eguchi ..... G03G 15/706 399/22
2014/0321877 A1* 10/2014 Ono ..... B65H 31/02 399/92
2014/0336031 A1 11/2014 Suzuki et al.
2014/0364295 A1 12/2014 Watanabe et al.
2015/0003860 A1* 1/2015 Shin ..... G03G 21/1638 399/98
2015/0031520 A1 1/2015 Nakada et al.
2015/0048137 A1* 2/2015 Misumi ..... B65H 37/04 227/19
2015/0104203 A1* 4/2015 Goto ..... G03G 15/502 399/20
2015/0225201 A1 8/2015 Watanabe et al.

FOREIGN PATENT DOCUMENTS

JP 2000-351475 A 12/2000
JP 2004-045538 A 2/2004
JP 2006-062779 A 3/2006
JP 2014-101164 A 6/2014

* cited by examiner

SHEET PROCESSING APPARATUS AND IMAGE FORMING SYSTEM

CROSS-REFERENCE TO RELATED APPLICATIONS

The present application is a continuation application of U.S. application Ser. No. 14/838,890, filed on Aug. 28, 2015, which claims priority under 35 U.S.C. § 119 to Japanese Patent Application No. 2014-179533 filed in Japan on Sep. 3, 2014 and Japanese Patent Application No. 2015-124860 filed in Japan on Jun. 22, 2015, the entire contents of each of which are hereby incorporated by reference herein.

BACKGROUND OF THE INVENTION

1. Field of the Invention

The present invention relates to a sheet processing apparatus and an image forming system.

2. Description of the Related Art

In recent years, image forming apparatuses used for become output of digitized information have become essential devices. In addition, folding process apparatuses, which are used by being coupled with or built in an image forming apparatus so as to fold a sheet on which an image is already formed, the image formed by the image forming apparatus, have also become essential devices.

In general, such folding process apparatuses are configured to perform a necessary process while conveying a sheet, that is, a folding process (for example, see Japanese Patent Application Laid-open No. H7-309525).

However, in a case where the conveyance of the sheet is stopped due to any cause such as a paper jam or a sensor abnormality in such folding process apparatus, it is hard to convey the sheet by itself until the cause of the stop is eliminated, in some cases. In such a case, a user needs to remove the sheet stopped inside the apparatus by himself, which is not easy.

Accordingly, among such folding process apparatuses, a folding process apparatus, in which a conveying roller that conveys a sheet is provided with a rotation knob that is rotated so as to rotate the conveying roller in conjunction with the rotation thereof, has already been known. According to such a folding process apparatus, the user can remove a stopped sheet outside the apparatus only by rotating the rotation knob.

Meanwhile, in general, a rotation direction is different for each conveying roller in the folding process apparatus. Accordingly, it is difficult for a user to grasp that the rotation knob of which of the conveyance rollers needs to be rotated in which direction, and thus, the sheet cannot be easily removed.

In view of the above, there is a need to enable a sheet stopped inside a sheet processing apparatus to be easily removed.

SUMMARY OF THE INVENTION

It is an object of the present invention to at least partially solve the problems in the conventional technology.

A sheet processing apparatus includes: a first conveying roller pair that conveys a sheet; a second conveying roller pair that receives the sheet conveyed by the first conveying roller pair, conveys the received sheet, and is capable of forward and reverse rotation; a first folding roller pair that forms a first fold on the sheet; and a first rotation unit capable of rotating the second conveying roller pair and the first folding roller pair. One roller of the second conveying roller pair and one roller of the first folding roller pair are a common roller shared therebetween. The second conveying roller pair causes the sheet to be deflected and guided to the first folding roller pair, and the first folding roller pair forms the first fold on the deflected sheet by rotating the first rotation unit in a certain direction in a state in which the sheet is held by the first conveying roller pair and the second conveying roller pair.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of the present invention will be described in detail with reference to the drawings. In the embodiment, a description will be made regarding a folding processing unit, as an example of a sheet processing apparatus, that is coupled with or built in an image forming unit, and folds a sheet on which an image is already formed, the image formed by the image forming unit.

Figure 1:
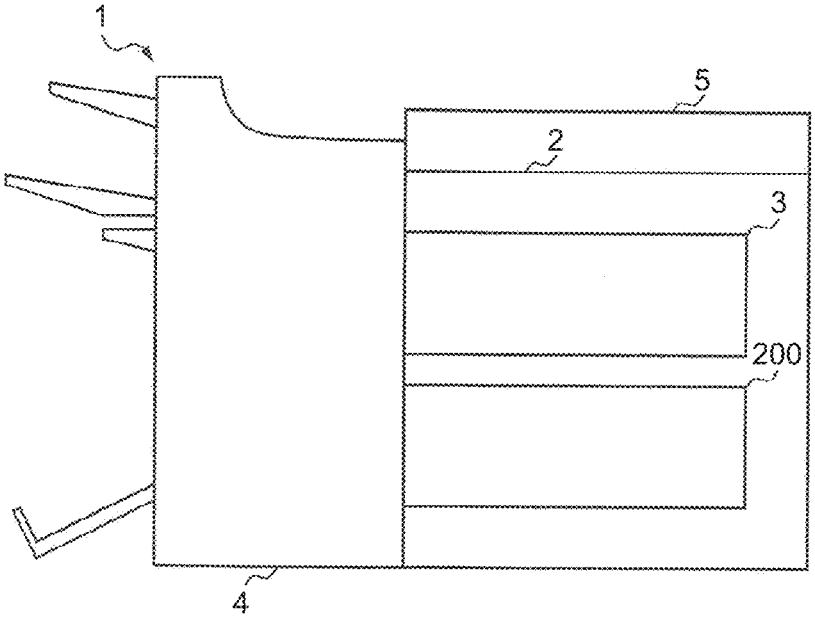
FIG. 1 is a diagram illustrating the entire configuration of an image forming apparatus according to an embodiment of the present invention in a simplified manner.

First, a description will be made regarding the entire configuration of an image forming apparatus 1 according to the embodiment with reference to FIG. 1. FIG. 1 is a diagram illustrating the entire configuration of the image forming apparatus 1 according to the embodiment in a simplified manner. As illustrated in FIG. 1, the image forming apparatus 1 according to the embodiment includes an image forming unit 2, a folding processing unit 3, a post-processing unit 4, and a scanner unit 5.

The image forming unit 2 generates drawing information of CMYK (Cyan Magenta Yellow Key Plate) based on input image data, and performs formation and output of an image with respect to sheet that has been fed, based on the generated drawing information. The folding processing unit 3 performs a folding process and a fold-enhancing process with respect to the sheet, on which an image is already formed, which has been conveyed from the image forming unit 2. The post-processing unit 4 performs a post-process such as bookbinding, stapling or punching with respect to the sheet, after being subjected to the folding process, which has been conveyed from the folding processing unit 3.

The scanner unit 5 digitizes a document by reading the document using a linear image sensor in which a plurality of photodiodes are aligned in a row, and light receiving elements such as a CCD (Charge Coupled Device) or CMOS (Complementary Metal Oxide Semiconductor) image sensor are arranged in parallel. It is noted that the image forming apparatus 1 according to the embodiment is an MFP (MultiFunction Peripheral) that is provided with an image pickup function, an image formation function, a communication function or the like so as to be usable as a printer, a facsimile, a scanner or a copier.

Figure 2:
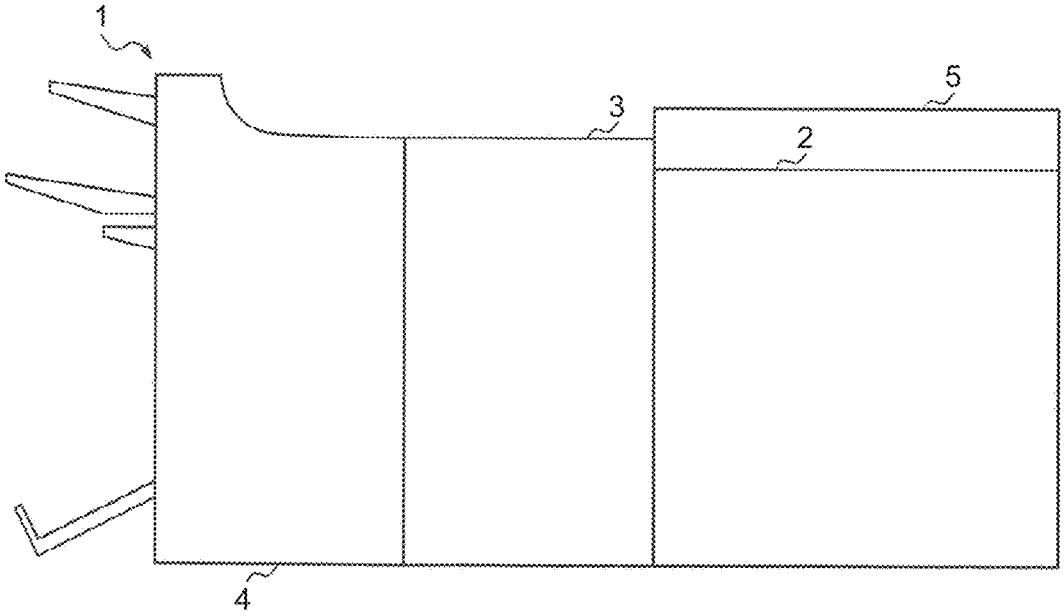
FIG. 2 is a diagram illustrating the entire configuration of an image forming apparatus according to the embodiment of the present invention in a simplified manner.

Furthermore, FIG. 1 illustrates a configuration in which the image forming apparatus 1 includes the folding processing unit 3 inside a body of the image forming unit 2, but it may be configured such that the image forming apparatus 1 includes the independent folding processing unit 3 as illustrated in FIG. 2. FIG. 2 is a diagram illustrating the entire configuration of an image forming apparatus 1 according to the embodiment in a simplified manner.

Figure 3:
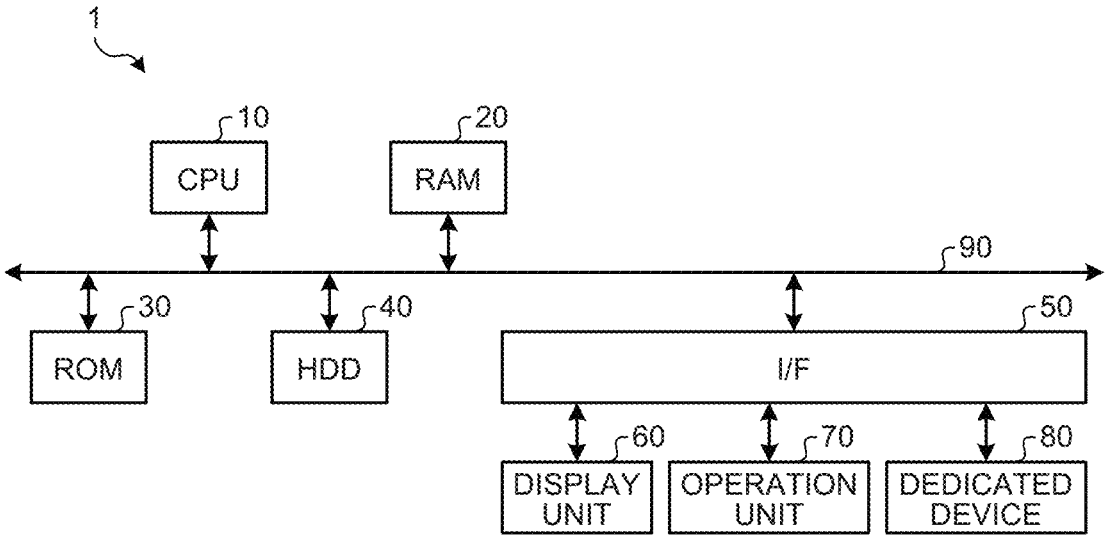
FIG. 3 is a block diagram schematically illustrating a hardware configuration of the image forming apparatus according to the embodiment of the present invention.

Next, a description will be made regarding a hardware configuration of the image forming apparatus 1 according to the embodiment with reference to FIG. 3. FIG. 3 is a block diagram schematically illustrating the hardware configuration of the image forming apparatus 1 according to the embodiment.

As illustrated in FIG. 3, the image forming apparatus 1 according to the embodiment has the same configuration as a general server or PC (Personal Computer). That is, in the image forming apparatus 1 according to the embodiment, a CPU (Central Processing Unit) 10, a RAM (Random Access Memory) 20, a ROM (Read Only Memory) 30, an HDD (Hard Disk Drive) 40 and an I/F 50 are connected to one another by a bus 90. In addition, the I/F 50 is connected with a display unit 60, an operation unit 70 and a dedicated device 80.

The CPU 10 is a calculation unit and controls the entire operation of the image forming apparatus 1. The RAM 20 is a volatile storage medium capable of reading and writing of information at high speed, and is used as a work area when the CPU 10 processes the information. The ROM 30 is a non-volatile storage medium dedicated for reading, and in which a program such as firmware is stored. The HDD 40 is a non-volatile storage medium capable of reading and writing of the information, and in which an OS (Operating System) and various types of control programs and application programs are stored.

The I/F 50 connects the bus 90 with various types of hardware and network, and performs control thereof. The display unit 60 is a visual user interface for allowing a user to check a state of the image forming apparatus 1, and is implemented by a display apparatus such as an LCD (Liquid Crystal Display). The operation unit 70 is a user interface, such as a keyboard or a mouse, for allowing the user to input the information into the image forming apparatus 1.

The dedicated device 80 is hardware for implementation of dedicated functions in the image forming unit 2, the folding processing unit 3, the post-processing unit 4 and the scanner unit 5, and is a plotter apparatus that performs the formation and output of the image on a sheet surface in the image forming unit 2.

In addition, in the folding processing unit 3, the dedicated devices 80 are a conveyance mechanism that conveys the sheet, a folding process mechanism that folds the conveyed sheet, and a fold-enhancing process mechanism that enhances the fold formed on the sheet. A configuration of the fold-enhancing process mechanism included in the folding processing unit 3 is one of points of the embodiment.

In addition, in the post-processing unit 4, the dedicated device 80 is a post-process mechanism that performs a post-process on the sheet conveyed from the image forming unit 2 or the folding processing unit 3. In addition, in the scanner unit 5, the dedicated devices 80 are a document reading mechanism that optically reads the document, and an automatic conveyance mechanism that automatically conveys the sheet.

In this hardware configuration, a program stored in a storage medium such as the ROM 30, the HDD 40 or an optical disk (not illustrated) is read onto the RAM 20, and the CPU 10 performs calculation according to the program loaded in the RAM 20, thereby forming a software control unit. A functional block that implements a function of the image forming apparatus 1 according to the embodiment is formed by combination of the software control unit formed in such a manner and the hardware.

Figure 4:
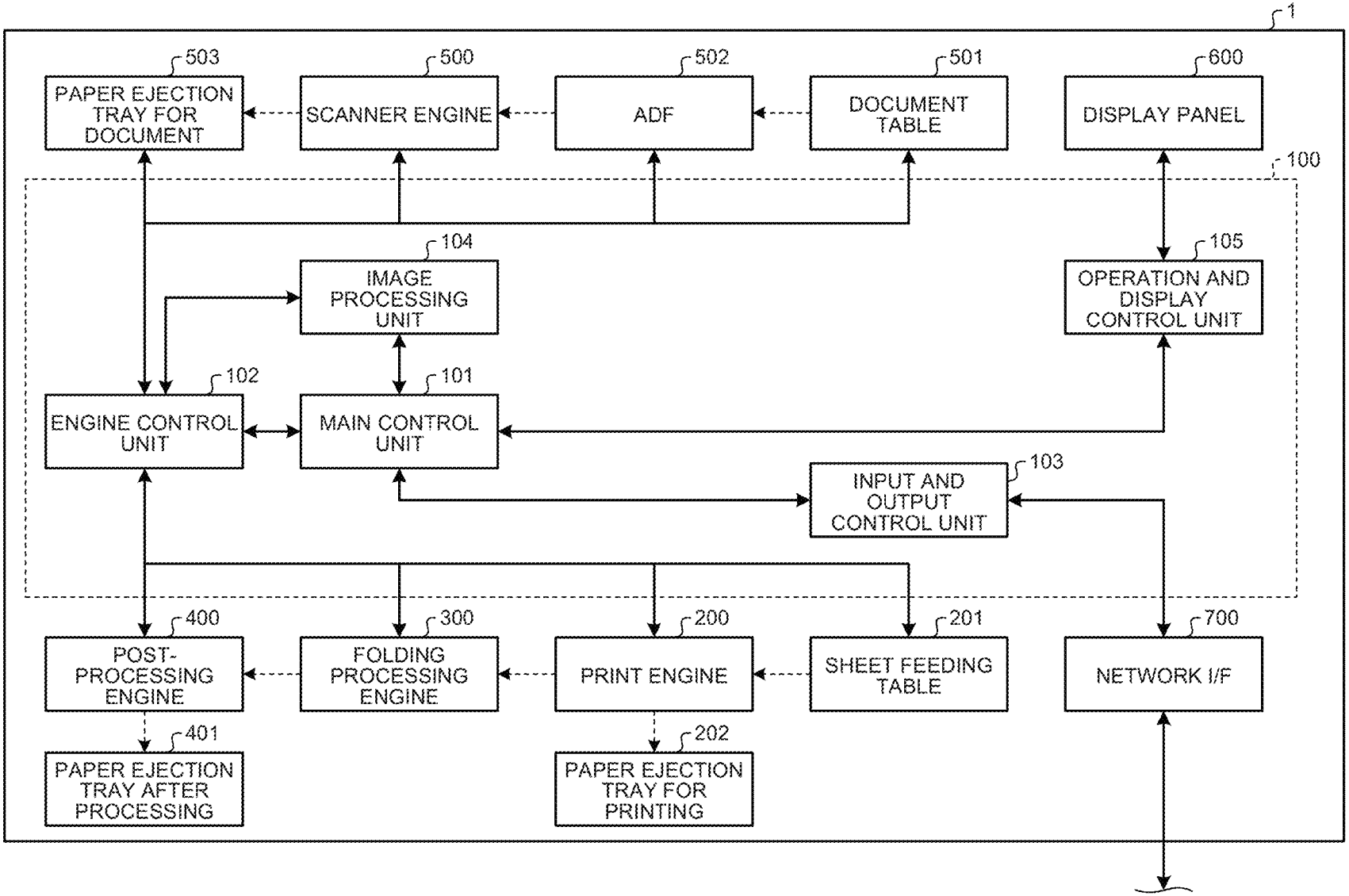
FIG. 4 is a block diagram schematically illustrating a functional configuration of the image forming apparatus according to the embodiment of the present invention.

Next, a description will be made regarding a functional configuration of the image forming apparatus 1 according to the embodiment with reference to FIG. 4. FIG. 4 is a block diagram schematically illustrating the functional configuration of the image forming apparatus 1 according to the embodiment. It is noted that, in FIG. 4, an electrical connection is indicated by a solid arrow, and a flow of the sheet or a document bundle is indicated by a dashed arrow.

As illustrated in FIG. 4, the image forming apparatus 1 according to the embodiment has a controller 100, a print engine 200, a sheet feeding table 201, a paper ejection tray for printing 202, a folding processing engine 300, a post-processing engine 400, a paper ejection tray after processing 401, a scanner engine 500, a document table 501, an ADF (Auto Document Feeder) 502, a paper ejection tray for a document 503, a display panel 600, and a network I/F 700. In addition, the controller 100 has a main control unit 101, an engine control unit 102, an input and output control unit 103, an image processing unit 104, and an operation and display control unit 105.

The print engine 200 is an imaging forming unit provided in the image forming unit 2, and draws an image by performing formation and output of an image on the sheet which has been conveyed from the sheet feeding table 201. It is possible to use an imaging forming mechanism using an inkjet system, an imaging forming mechanism using an electrophotography system, or the like as a detailed form of the print engine 200.

The sheet on which the image is already formed, the image drawn by the print engine 200, is conveyed to the folding processing unit 3, or is ejected to the paper ejection tray for printing 202. The print engine 200 is implemented by the dedicated device 80 illustrated in FIG. 3. The sheet feeding table 201 feeds the sheet to the print engine 200 which is the imaging forming unit.

Furthermore, the folding processing unit 3 is arranged above the print engine 200 as illustrated in FIG. 1 in the case where the folding processing unit 3 is built in the image forming unit 2. In addition, the folding processing unit 3 is arranged in a horizontal direction of the image forming unit 2 as illustrated in FIG. 2 in the case where the folding processing unit 3 is connected to the image forming unit 2.

The folding processing engine 300 is provided in the folding processing unit 3, and performs the folding process and the fold-enhancing process on the sheet which has been conveyed from the image forming unit 2. The sheet after being subjected to the folding process, on which the folding process is already performed by the folding processing engine 300, is conveyed to the post-processing unit 4. The folding processing engine 300 is implemented by the dedicated device 80 illustrated in FIG. 3.

The post-processing engine 400 is included in the post-processing unit 4, and performs the post-process such as stapling, punching or bookbinding on the sheet which has been conveyed from the folding processing engine 300. The sheet on which the post-process is already performed by the post-processing engine 400 is ejected to the paper ejection tray after processing 401. The post-processing engine 400 is implemented by the dedicated device 80 illustrated in FIG. 3.

The scanner engine 500 is provided in the scanner unit 5, is a document reading unit that includes a photoelectric conversion element to convert optical information into an electrical signal, and generates image information by optically scanning and reading a document that has been automatically conveyed from the document table 501 by the ADF 502, or a document set in a document table glass.

The document, automatically conveyed from the document table 501 by the ADF 502 and read by the scanner engine 500, is ejected to the paper ejection tray for a document 503.

The scanner engine 500 is implemented by the dedicated device 80 illustrated in FIG. 3. The ADF 502 is provided in the scanner unit 5, and automatically conveys the document set in the document table 501 to the scanner engine 500. The ADF 502 is implemented by the dedicated device 80 illustrated in FIG. 3.

The display panel 600 is an output interface that visually displays a state of the image forming apparatus 1, and further is an input interface as a touch panel when a user directly operates the image forming apparatus 1 or inputs information into the image forming apparatus 1. That is, the display panel 600 has a function of displaying an image for receiving the operation by the user. The display panel 600 is implemented by the display unit 60 and the operation unit 70 illustrated in FIG. 3.

The network I/F 700 is an interface for communication between the image forming apparatus 1 and other devices such as a terminal for an administrator or a PC (Personal Computer) via the network, and employs an interface of an Ethernet (registered trademark) or USB (Universal Serial Bus) interface, Bluetooth (registered trademark), Wi-Fi (Wireless Fidelity) (registered trademark), or FeliCa (registered trademark). In this manner, the image forming apparatus 1 according to the embodiment receives the image data for requesting printing and various control commands such as a print request from a terminal connected via the network I/F 900. The network I/F 700 is implemented by the I/F 50 illustrated in FIG. 3.

The controller 100 is formed by the combination of the software and the hardware. To be specific, the controller 100 is formed of the software control unit configured such that control programs such as the firmware stored in the non-volatile storage medium such as the ROM 30 or the HDD 40 is loaded in the RAM 20, and the CPU 10 performs calculation according to such programs, and the hardware such as an integrated circuit. The controller 100 functions as the control unit that controls the entire image forming apparatus 1.

The main control unit 101 serves to control each part included in the controller 100, and gives a command to each part of the controller 100. In addition, the main control unit 101 controls the input and output control unit 103, and accesses the other devices via the network I/F 700 and the network.

The engine control unit 102 controls or drives a driving unit of the print engine 200, the folding processing engine 300, the post-processing engine 400, the scanner engine 500, and the like. The input and output control unit 103 inputs a signal and the command input via the network I/F 190 and the network to the main control unit 101.

The image processing unit 104 generates the drawing information, as output information, based on the image information described in a PDL (Page Description Language) or the like, such as document data or the image data included in a print job that has been input, in accordance with the control of the main control unit 101. The drawing information is information of bitmap data of CMYK or the like, and is information that allows the print engine 200, which is the imaging forming unit, to draw an image that needs to be formed in the image forming operation.

In addition, the image processing unit 104 processes image pickup data input from the scanner engine 500, and generates the image data. The image data is information to be stored in the image forming apparatus 1 as a result of a scanner operation, or to be transmitted to the other devices via the network I/F 700 and the network.

Furthermore, the image forming apparatus 1 according to the embodiment is capable of causing the drawing information to be directly input instead of the image information, and performing the formation and output of the image based on the drawing information that has been directly input.

The operation and display control unit 105 displays the information on the display panel 600, or notifies the main control unit 101 of the information input via the display panel 600.

Figure 5A:
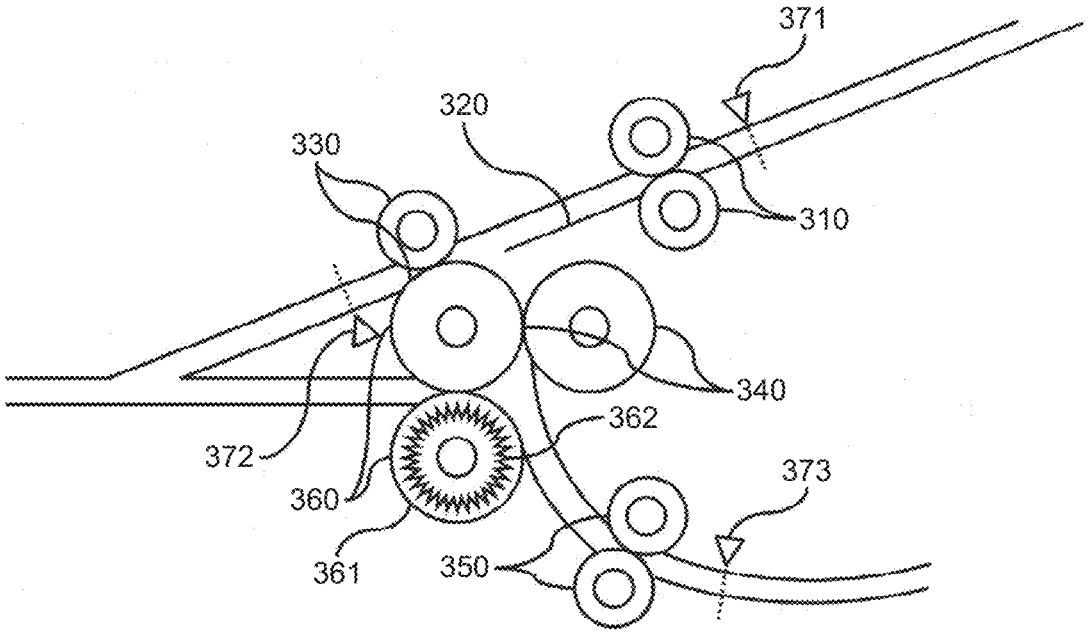
FIGS. 5A and 5B are diagrams illustrating forms when a folding processing unit according to the embodiment of the present invention is in a through mode and a folding mode.
Figure 5B:
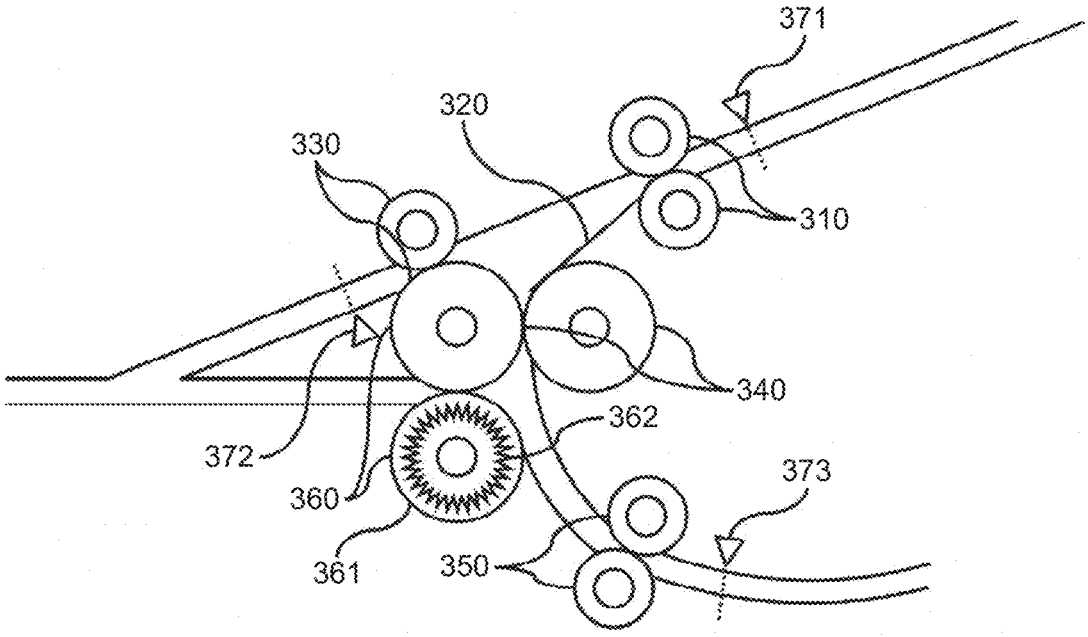

Next, a description will be made regarding a mode that the folding processing unit 3 according to the embodiment can take with reference to FIGS. 5A and 5B. FIGS. 5A and 5B are diagrams illustrating forms when the folding processing unit 3 according to the embodiment is in a through mode and a folding mode, respectively.

As illustrated in FIG. 5A, when the folding processing unit 3 according to the embodiment is in the through mode, a bifurcating claw 320 is in a closed state with respect to a first folding processing roller pair 340, that is, in a state in which the sheet, which has been conveyed from the image forming unit 2, is guided to a first forward and reverse rotation roller pair 330.

On the other hand, as illustrated in FIG. 5B, when the folding processing unit 3 according to the embodiment is in the folding mode, the bifurcating claw 320 is in an opened state with respect to the first folding processing roller pair 340, that is, in a state in which the sheet, which has been conveyed from the image forming unit 2, is guided to the first folding processing roller pair 340. In other words, in the embodiment, the bifurcating claw 320 functions as a first guide unit, and the engine control unit 102 functions as a first guide control unit.

Furthermore, when the folding processing unit 3 according to the embodiment is in a normal state, the bifurcating claw 320 is in a closed state with respect to the first folding processing roller pair 340 as illustrated in FIG. 5A.

In the case of being configured in such a manner, in the folding mode, the folding processing unit 3 shifts the bifurcating claw 320 from the closed state to the opened state with respect to the first folding processing roller pair 340 when deflection is formed in a first folding position formed in a sheet 6 as described below. Further, the folding processing unit 3 returns to the normal state by shifting the bifurcating claw 320 from the opened state to the closed state with respect to the first folding processing roller pair 340 when the folding processing operation is completed.

In addition, when the folding processing unit 3 according to the embodiment in the normal state, the bifurcating claw 320 may be in the opened state with respect to the first folding processing roller pair 340 as illustrated in FIG. 5B.

In the case of being configured in such a manner, the folding processing unit 3 is configured to shift the bifurcating claw 320 from the opened state to the closed state with respect to the first folding processing roller pair 340 when the sheet 6 is conveyed from an inlet conveying roller pair 310 toward the first forward and reverse rotation roller pair 330. Further, when the conveyance of the sheet 6 by the first forward and reverse rotation roller pair 330 is started, the folding processing unit 3 returns to the normal state by shifting the bifurcating claw 320 from the closed state to the opened state with respect to the first folding processing roller pair 340.

Accordingly, in a case where the folding processing unit 3 is configured in such a manner, the bifurcating claw 320 is already in the opened state with respect to the first folding processing roller pair 340 in a case where the conveyance of the sheet 6 is stopped other than a case where the sheet 6 is conveyed from the inlet conveying roller pair 310 toward the first forward and reverse rotation roller pair 330. Thus, in such a case, the folding processing unit 3 does not need an operation of shifting the bifurcating claw 320 from the closed state to the opened state with respect to the first folding processing roller pair 340.

Further, in the through mode, the folding processing unit 3 returns to the normal state by shifting the bifurcating claw 320 from the closed state to the opened state with respect to the first folding processing roller pair 340 when a trailing end in a conveying direction of the sheet 6, which has been conveyed from the inlet conveying roller pair 310 toward the first forward and reverse rotation roller pair 330, passes through the first forward and reverse rotation roller pair 330, or is detected by a second sheet detection sensor 372.

On the contrary, in the folding mode, the folding processing unit 3 returns to the normal state by shifting the bifurcating claw 320 from the closed state to the opened state with respect to the first folding processing roller pair 340 when the deflection is formed in the first folding position of the sheet 6 which has been conveyed from the inlet conveying roller pair 310 toward the first forward and reverse rotation roller pair 330.

Figure 6A:
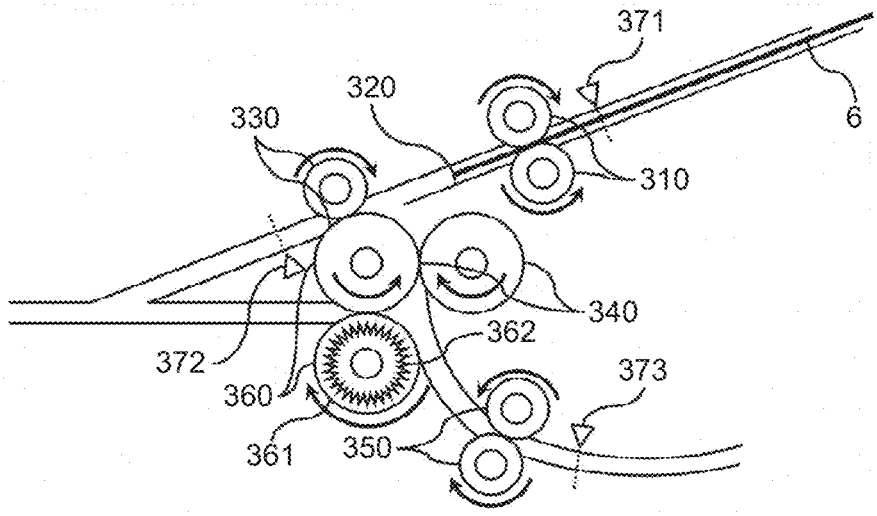
FIGS. 6A to 6C are cross-sectional views, from a main scanning direction, illustrating the folding processing unit during a folding processing operation in the image forming apparatus according to the embodiment of the present invention.
Figure 6B:
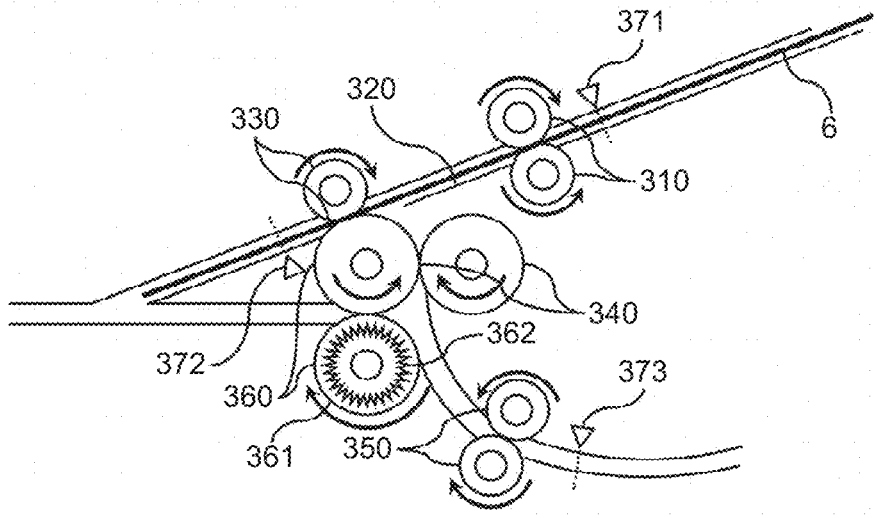
Figure 6C:
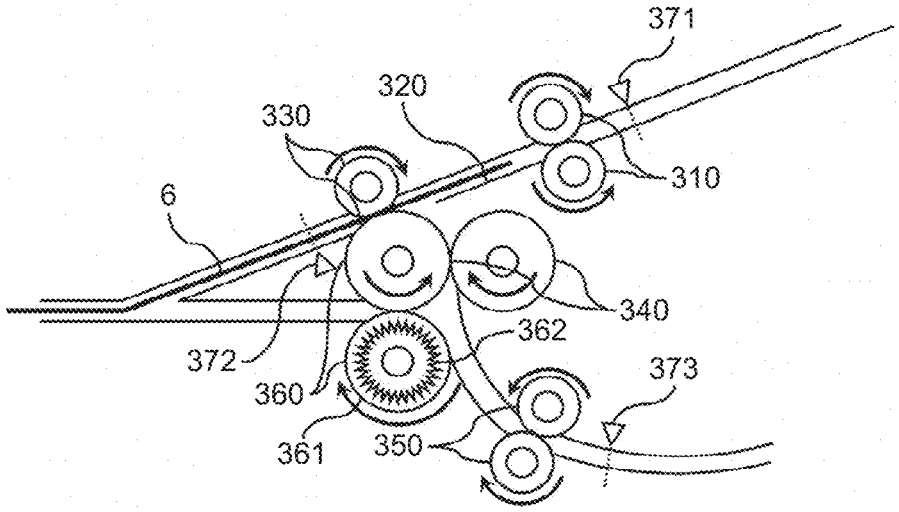

Next, a description will be made regarding an operation example when the folding processing unit 3 according to the embodiment is in the through mode with reference to FIGS. 6A to 6C. FIGS. 6A to 6C are cross-sectional views, from a main scanning direction, illustrating the folding processing unit 3 during the through mode in the image forming apparatus 1 according to the embodiment.

In a case where the folding processing unit 3 according to the embodiment is in the folding mode, first, the folding processing unit 3 detects a leading end of the sheet 6 in the conveying direction by a first sheet detection sensor 371 when the sheet 6 is conveyed from the image forming unit 2, and starts rotation of each roller as illustrated in FIG. 6A. Further, the folding processing unit 3 receives the sheet 6, by the inlet conveying roller pair 310, when the sheet 6 is conveyed from the image forming unit 2, and conveys the sheet 6 toward the first forward and reverse rotation roller pair 330.

The folding processing unit 3 further conveys the sheet 6, which has been conveyed from the inlet conveying roller pair 310, downstream in the conveying direction by the first forward and reverse rotation roller pair 330 as illustrated in FIG. 6B, and conveys the sheet 6 toward the post-processing unit 4 as illustrated in FIG. 6C.

Next, a description will be made regarding an operation example when the folding processing unit 3 according to the embodiment is in the folding mode with reference to FIGS. 7A to 9C. FIGS. 7A to 9C are cross-sectional views, from the main scanning direction, illustrating the folding processing unit 3 during the folding mode in the image forming apparatus 1 according to the embodiment. Furthermore, FIGS. 7A to 9C illustrate the operation examples when the folding processing unit 3 performs a three-fold.

Figure 7A:
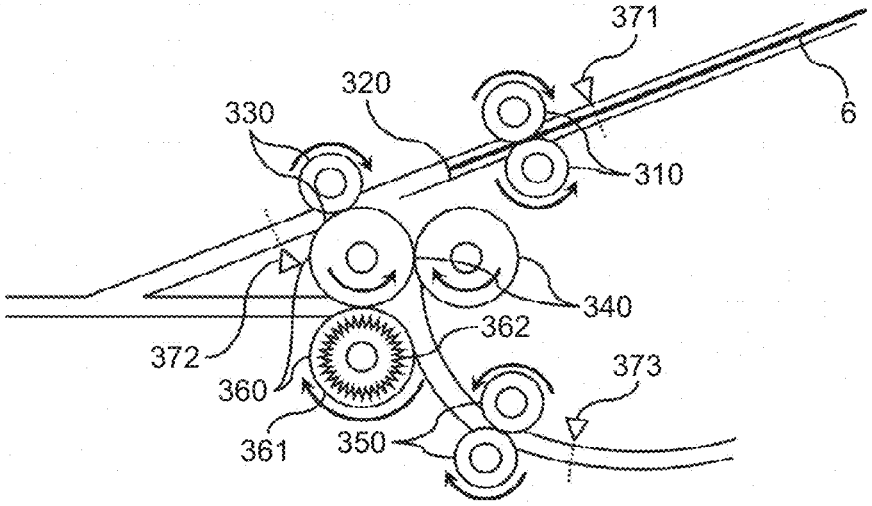
FIGS. 7A to 7C are cross-sectional views, from a main scanning direction, illustrating the folding processing unit during a folding processing operation in the image forming apparatus according to the embodiment of the present invention.

In a case where the folding processing unit 3 according to the embodiment is in the folding mode, first, the folding processing unit 3 detects the leading end of the sheet 6 in the conveying direction by the first sheet detection sensor 371 when the sheet 6 is conveyed from the image forming unit 2, and starts the rotation of each roller as illustrated in FIG. 7A.

Further, the folding processing unit 3 receives the sheet 6, by the inlet conveying roller pair 310, when the sheet 6 is conveyed from the image forming unit 2, and conveys the sheet 6 toward the first forward and reverse rotation roller pair 330. That is, in the embodiment, the inlet conveying roller pair 310 functions as a first conveying roller pair.

The folding processing unit 3 further conveys the sheet 6, which has been conveyed by the inlet conveying roller pair 310, downstream in the conveying direction by the first forward and reverse rotation roller pair 330 as illustrated in FIG. 5B.

Figure 7B:
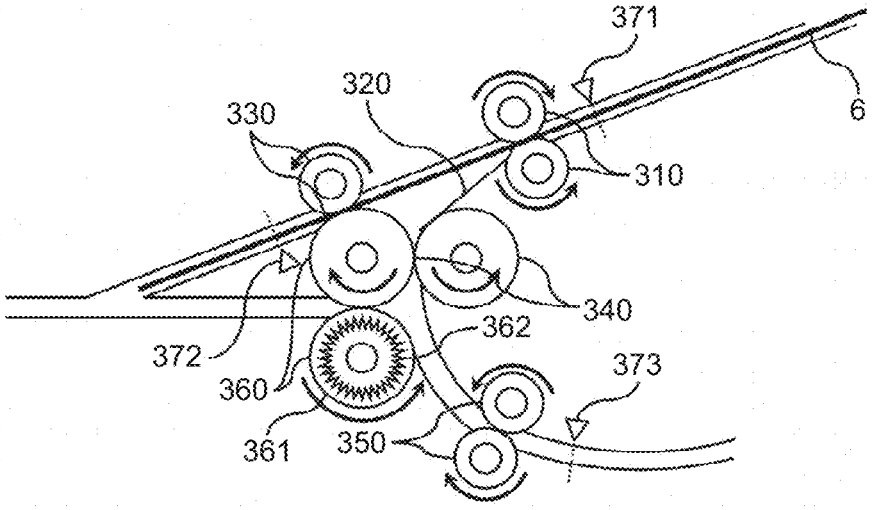

Thereafter, when the folding processing unit 3 conveys the sheet 6 by a predetermined distance S1 after detecting the leading end of the sheet 6 in the conveying direction by the second sheet detection sensor 372, as illustrated in FIG. 7B, the bifurcating claw 320 is shifted from the closed state to the opened state with respect to the first folding processing roller pair 340, and further a rotation direction of the first forward and reverse rotation roller pair 330 is reversed.

Figure 7C:
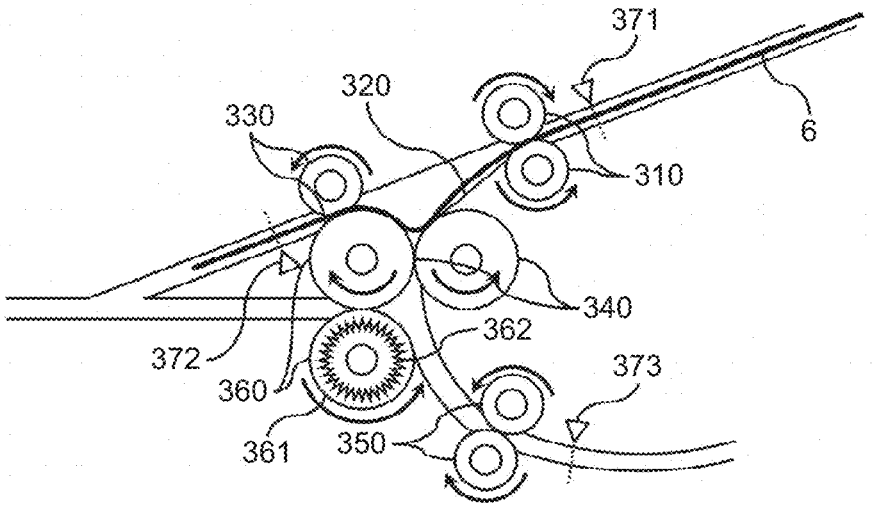

In this manner, as illustrated in FIG. 7C, the folding processing unit 3 causes the first folding position of the sheet 6 to be deflected toward the first folding processing roller pair 340, and guides the deflection to a nipping portion of the first folding processing roller pair 340 by further conveying the sheet 6 while preventing a position of the formed deflection from being displaced. That is, in the embodiment, the first forward and reverse rotation roller pair 330 functions as a second conveying roller pair.

Figure 8A:
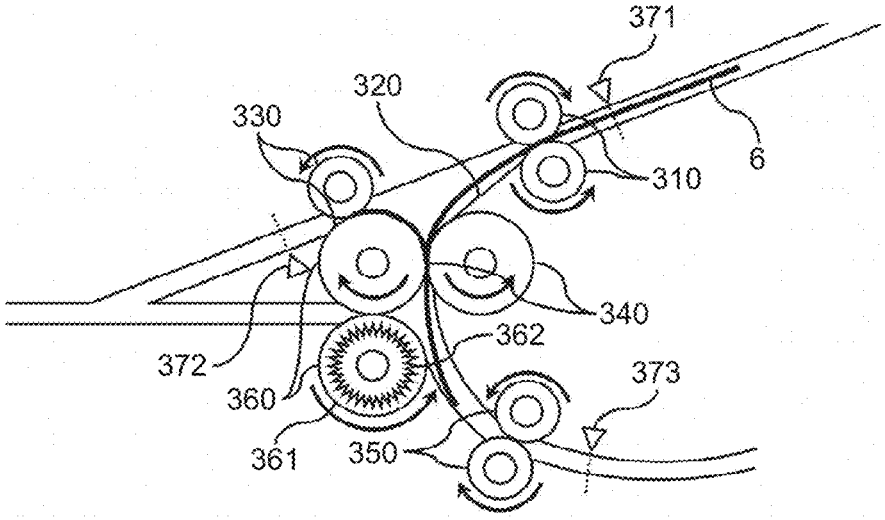
FIGS. 8A to 8C are cross-sectional views, from a main scanning direction, illustrating the folding processing unit during a folding processing operation in the image forming apparatus according to the embodiment of the present invention.
Figure 8B:
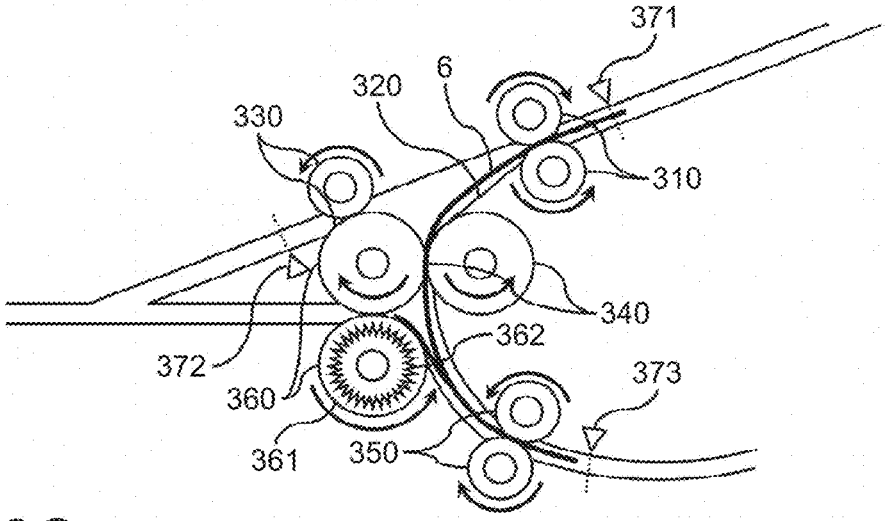
Figure 8C:
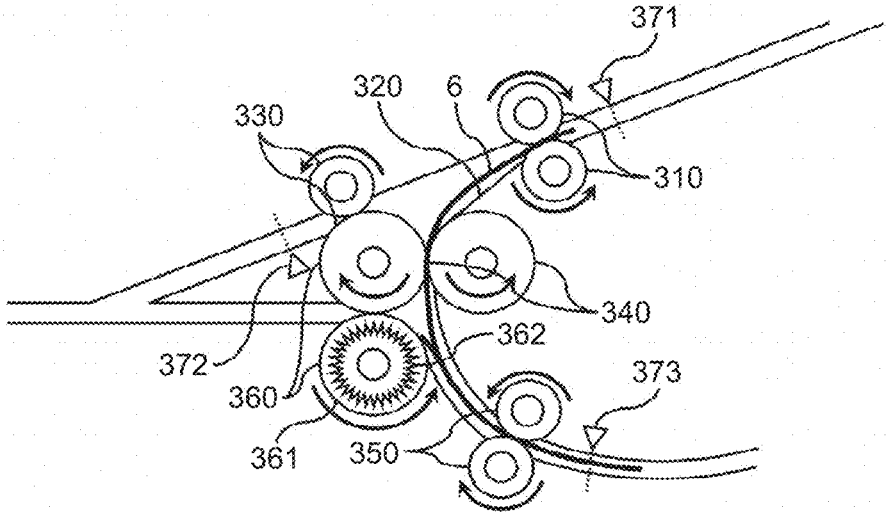

Further, as illustrated in FIG. 8A, the folding processing unit 3 forms a fold at the first folding position by sandwiching the deflection formed on the sheet 6, from both sides by the nipping portion of the first folding processing roller pair 340, and further conveys the sheet 6 toward a second forward and reverse roller pair 350 as illustrated in FIGS. 8B and 8C, and further conveys the sheet 6 downstream in the conveying direction. That is, in the embodiment, the first folding processing roller pair 340 functions as a first folding roller pair.

Figure 9A:
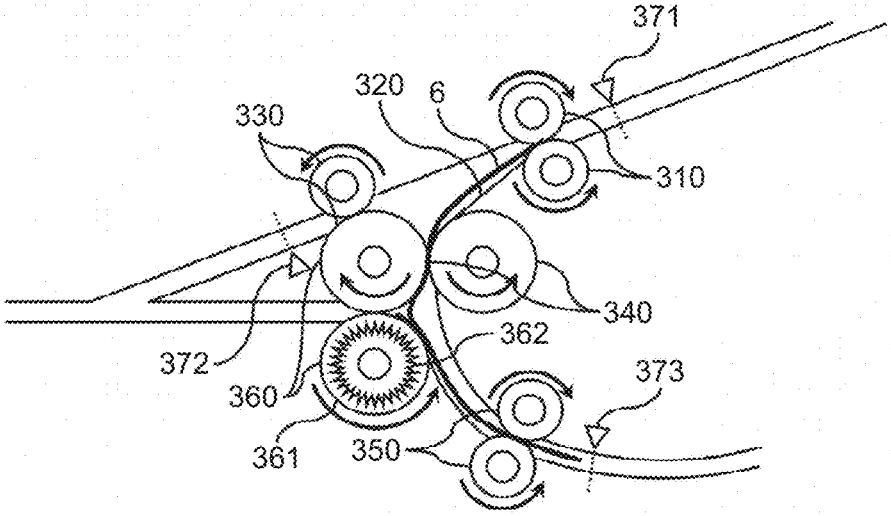
FIGS. 9A to 9C are cross-sectional views, from a main scanning direction, illustrating the folding processing unit during a folding processing operation in the image forming apparatus according to the embodiment of the present invention.

Thereafter, when the folding processing unit 3 conveys the sheet 6 by a predetermined distance S2 after detecting the leading end of the sheet 6 in the conveying direction by a third sheet detection sensor 373, as illustrated in FIG. 9A, the rotation direction of the second forward and reverse roller pair 350 is reversed, and the folding processing unit 3 guides the deflection to a nipping portion of a second folding processing roller pair 360 by causing a second folding position of the sheet 6 to be deflected toward the second folding processing roller pair 360, and further conveying the sheet 6 while preventing the position of the formed deflection from being displaced. That is, in the embodiment, the second forward and reverse roller pair 350 functions as a third conveying roller pair.

Figure 9B:
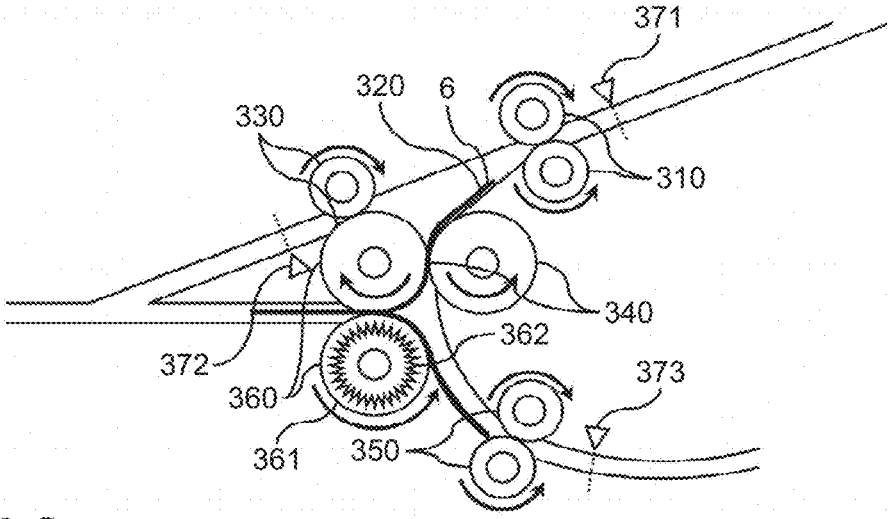
Figure 9C:
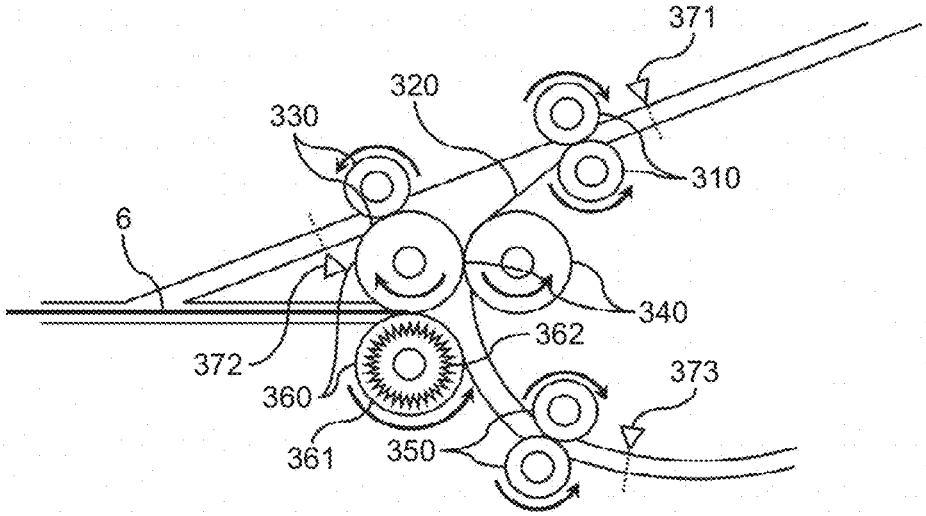

Further, as illustrated in FIG. 9B, the folding processing unit 3 forms a fold at the second folding position by sandwiching the deflection formed on the sheet 6, from both sides by the nipping portion of the second folding processing roller pair 360, and further conveys the sheet 6 toward the post-processing unit 4 as illustrated in FIG. 9C. That is, in the embodiment, the second folding processing roller pair 360 functions as a second folding roller pair.

Furthermore, in the embodiment, a roller shared in the first forward and reverse rotation roller pair 330, the first folding processing roller pair 340 and the second folding processing roller pair 360 function as a common roller.

Figure 10:
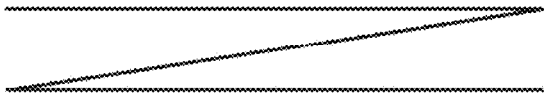
FIG. 10 is a diagram illustrating an example of a shape of a sheet being folded in three outward by the folding processing unit according to the embodiment of the present invention.

As a result of the operations illustrated in FIGS. 7A to 9C, the state in which the sheet 6 is folded in three outward as illustrated in FIG. 10 is reached.

Furthermore, in FIGS. 7A to 9C, the description has been made regarding the example in which the sheet 6 is folded in three outward by the folding processing unit 3. In addition to this, the folding processing unit 3 is capable of folding the sheet 6 in other folding modes such as an inner three-fold or a Z-fold by changing the distance S1 and the distance S2 depending on folding information such as a way of folding or a size of the sheet 6 while performing the same operations as described in FIGS. 7A to 9C. The distances S1 and S2 are determined in advance depending on the folding information, and stored in the non-volatile storage medium such as the ROM 30 or the HDD 40.

In other words, the folding processing unit 3 is capable of folding the sheet 6 in the other folding modes such as the inner three-fold or the Z-fold by changing a timing at which each rotation direction of the first forward and reverse rotation roller pair 330 and the second forward and reverse roller pair 350 is reversed depending on the folding information.

In some cases, the folding processing unit 3 configured in such a manner become unable to convey the sheet 6 by itself in a case where the conveyance of the sheet 6 is stopped due to a paper jam, an abnormality in a sensor, an abnormality of opening of a cover, or the like, until such a cause of the stop is eliminated. In such a case, a user needs to remove the sheet stopped inside the apparatus by himself, which is not easy.

Accordingly, the folding processing unit 3 according to the embodiment includes a first rotation knob 362, which is rotated so as to rotate the second folding processing roller pair 360 in a direction of the rotation when the sheet 6 is conveyed, in conjunction with the rotation thereof, in a folding processing roller 361 as one of the points. Accordingly, even in a case where the folding processing unit 3 stops the conveyance of the sheet 6 at the time of the generation of the abnormality, the user can easily remove the sheet 6 by rotating the first rotation knob 362.

Next, a description will be made regarding procedures when the user removes the sheet 6 in a case where the folding processing unit 3 according to the embodiment stops the conveyance of the sheet 6 due to the generation of the abnormality in the folding mode with reference to FIGS. 11A to 13C. FIGS. 11A to 13C are diagrams illustrating the procedures when the user removes the sheet 6 in a case where the folding processing unit 3 according to the embodiment stops the conveyance of the sheet 6 due to the generation of the abnormality in the folding mode.

Figure 11A:
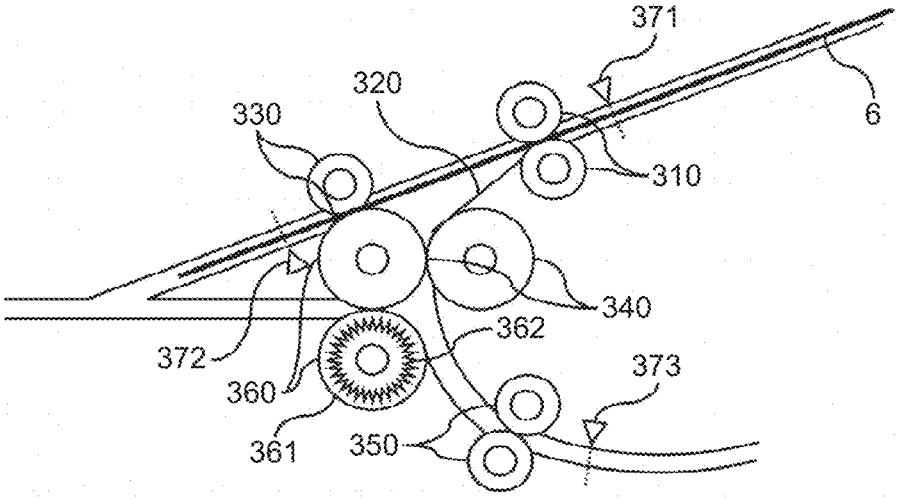
FIGS. 11A to 11C are diagrams illustrating procedures when a user removes a sheet stopped in the folding mode of the folding processing unit according to the embodiment of the present invention.
Figure 11B:
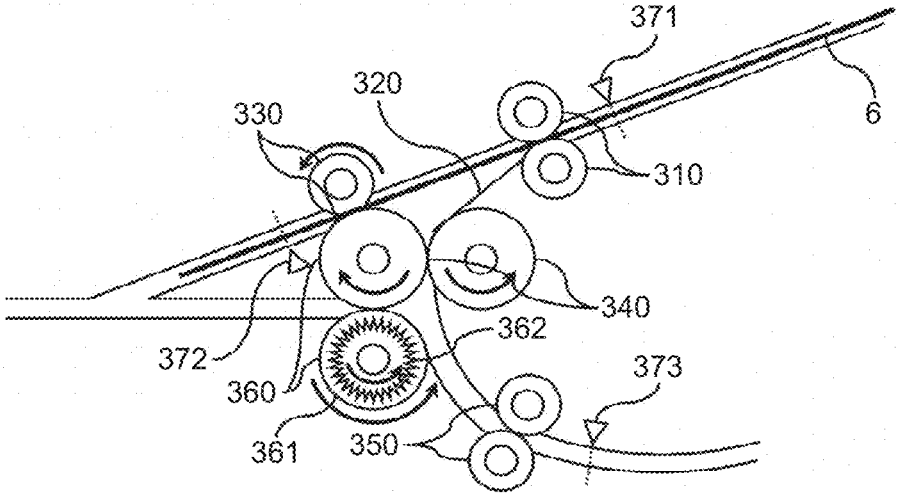

As illustrated in FIG. 11A, in a case where the folding processing unit 3 according to the embodiment stops the conveyance of the sheet 6 due to the generation of the abnormality in the folding mode, first, the user manually rotates the first rotation knob 362 in the arrow direction illustrated in FIG. 11B.

Further, when the first rotation knob 362 rotates in the arrow direction illustrated in FIG. 11B, a rotational force thereof is transmitted to the folding processing roller 361. As a result, the second folding processing roller pair 360 rotates in the arrow direction illustrated in FIG. 11B in conjunction with the rotation of the first rotation knob 362. That is, in the embodiment, the first rotation knob 362 functions as a first rotation unit.

Furthermore, in the embodiment, the first rotation knob 362 is arranged inside a door, and is configured such that the user opens the door and rotates the first rotation knob 362 if necessary. Further, in addition to this, the first rotation knob 362 may be configured to be detachable and to be rotated after being mounted on the folding processing roller 361 by the user if necessary. In addition, the first rotation knob 362 may be arranged in, at least, any roller of the first forward and reverse rotation roller pair 330, the first folding processing roller pair 340 and the second folding processing roller pair 360.

Further, when the second folding processing roller pair 360 rotates, the first forward and reverse rotation roller pair 330 and the first folding processing roller pair 340 rotate in the arrow direction illustrated in FIG. 11B following the rotation of the second folding processing roller pair 360.

Each rotation direction of the first forward and reverse rotation roller pair 330, the first folding processing roller pair 340 and the second folding processing roller pair 360 at this time is the same direction as the rotation direction when the sheet 6 is conveyed in the folding mode.

Furthermore, the first rotation knob 362 is configured such that the rotational force is transmitted to the folding processing roller 361 to rotate the folding processing roller 361 only in the case where the first rotation knob 362 is rotated in the arrow direction illustrated in FIG. 11B, and the rotational force is not transmitted to the folding processing roller 361 in the case where the first rotation knob 362 is rotated in an opposite direction and thus idles.

Figure 11C:
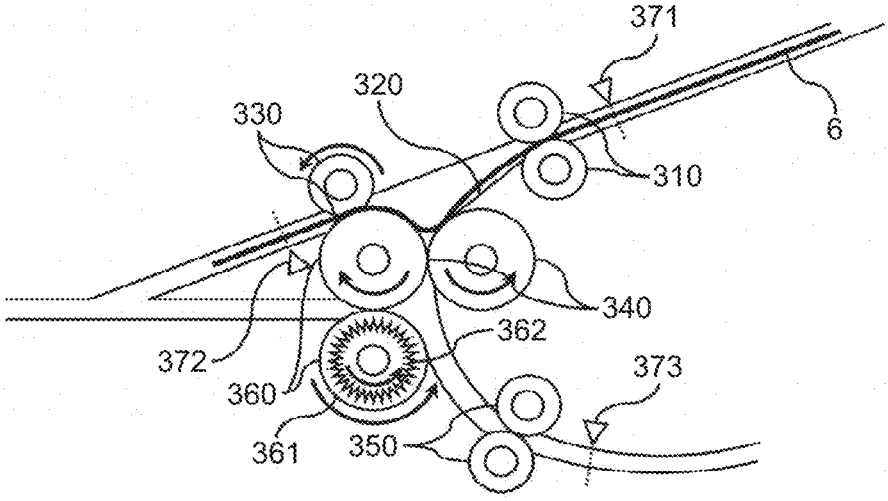

When the user rotates the first rotation knob 362 in such a state, the folding processing unit 3 further conveys the sheet 6 while causing the first folding position of the sheet 6 to be deflected toward the first folding processing roller pair 340 so as to guide the deflection to the nipping portion of the first folding processing roller pair 340 as illustrated in FIG. 11C.

Figure 12A:
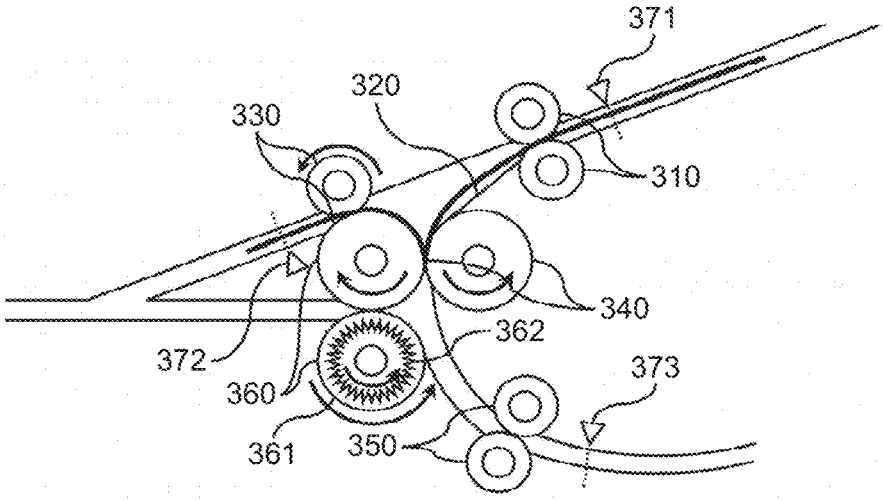
FIGS. 12A to 12C are diagrams illustrating procedures when a user removes a sheet stopped in the folding mode of the folding processing unit according to the embodiment of the present invention.
Figure 12B:
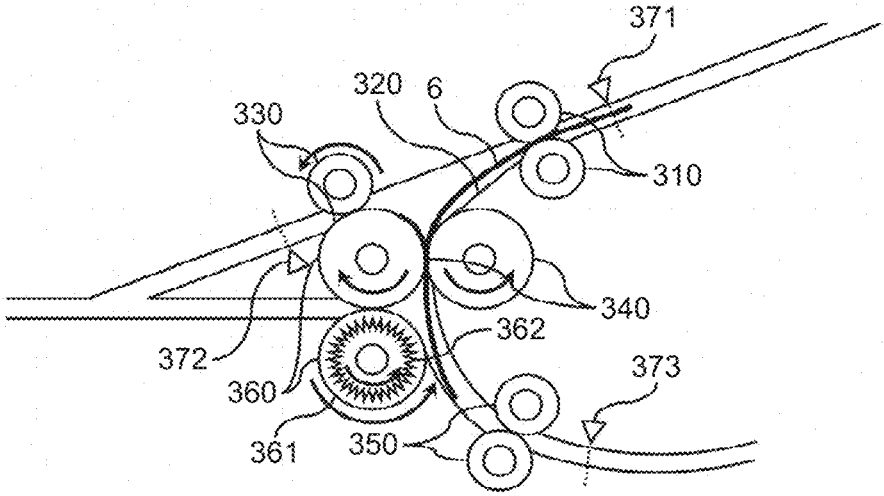

Further, when the user further rotates the first rotation knob 362, the folding processing unit 3 sandwiches the deflection formed on the sheet 6 from both sides by the nipping portion of the first folding processing roller pair 340 and forms a fold at the first folding position as illustrated in FIG. 12A, and further conveys the sheet 6 toward the second forward and reverse roller pair 350, and further conveys the sheet 6 downstream in the conveying direction as illustrated in FIG. 12B.

Figure 12C:
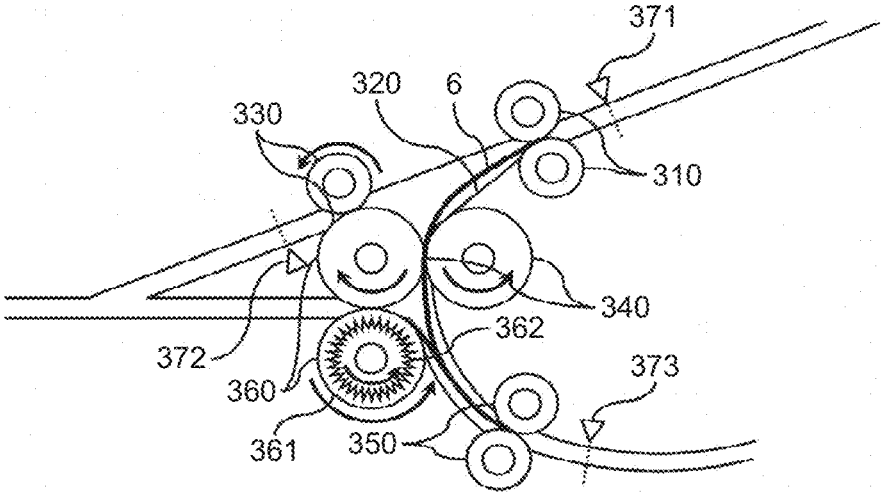
Figure 13A:
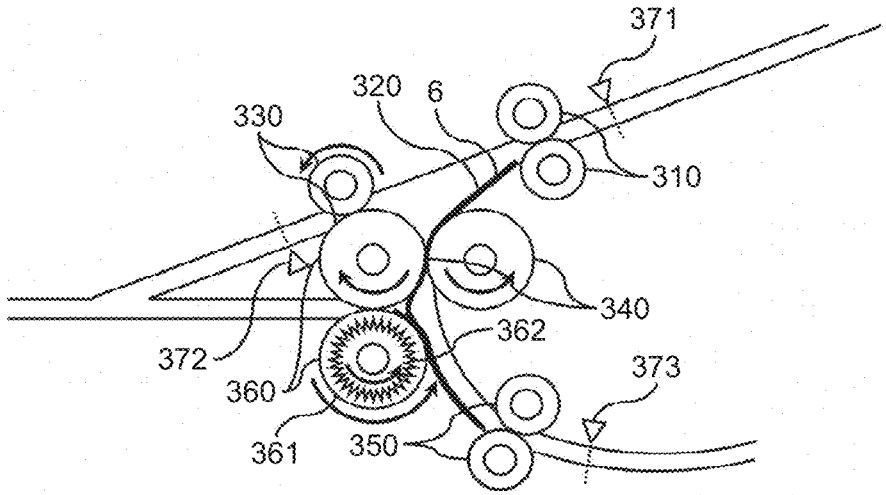
FIGS. 13A to 13C are diagrams illustrating procedures when a user removes a sheet stopped in the folding mode of the folding processing unit according to the embodiment of the present invention.

Thereafter, when the user further rotates the first rotation knob 362, the folding processing unit 3 reaches a state in which the leading end of the sheet 6 abuts against the second forward and reverse roller pair 350 as illustrated in FIG. 12C. In this state, when the user further rotates the first rotation knob 362, the folding processing unit 3 further conveys the sheet 6 while causing the second folding position of the sheet 6 to be deflected toward the second folding processing roller pair 360 so as to guide the deflection to the nipping portion of the second folding processing roller pair 360 as illustrated in FIG. 13A.

Figure 13B:
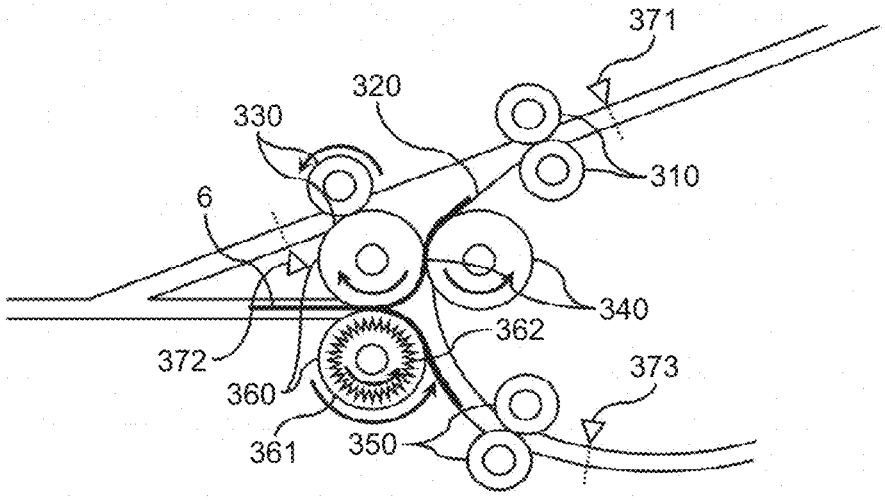
Figure 13C:
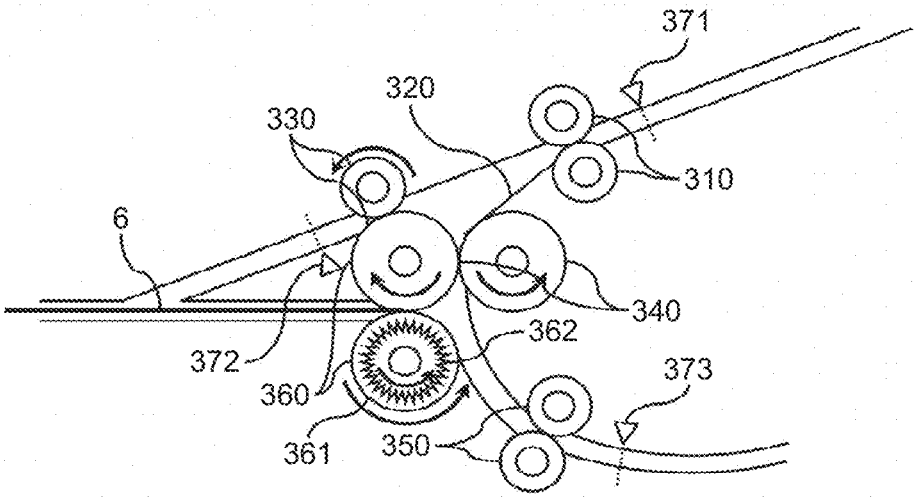

Further, when the user further rotates the first rotation knob 362, the folding processing unit 3 sandwiches the deflection formed on the sheet 6 from both sides by the nipping portion of the second folding processing roller pair 360 and forms a fold at the second folding position as illustrated in FIG. 13B, and further conveys the sheet 6 toward the post-processing unit 4 as illustrated in FIG. 13C. As a result, the sheet 6 is ejected in the state in which it is folded.

In this manner, according to the folding processing unit 3 according to the embodiment, even in a case where the conveyance of the sheet 6 is stopped due to the generation of the abnormality in the folding mode, the user can easily remove the sheet 6 only by rotating the first rotation knob 362.

Furthermore, in FIGS. 11A to 13C, the description has been made regarding the procedures when the sheet 6 whose conveyance is stopped at a position illustrated in FIG. 11A, is removed, but the same procedures are applied when the sheet 6 whose conveyance is stopped at each position illustrated in FIGS. 11B, 11C, 12A to 12C, and 13A to 13C, is removed.

In other words, in a case where the conveyance of the sheet 6 is stopped at each position illustrated in FIGS. 11A to 13C when the folding processing unit 3 according to the embodiment is in the folding mode, the user can easily remove the sheet 6 only by rotating the first rotation knob 362.

Hereinafter, in such a manner, a position of the sheet 6 at the time of allowing the sheet 6 to be removed by rotating the first rotation knob 362 in a case where the conveyance of the sheet 6 is stopped when the folding processing unit 3 is in the folding mode will be referred to as a "folding mode removal position".

Figure 14A:
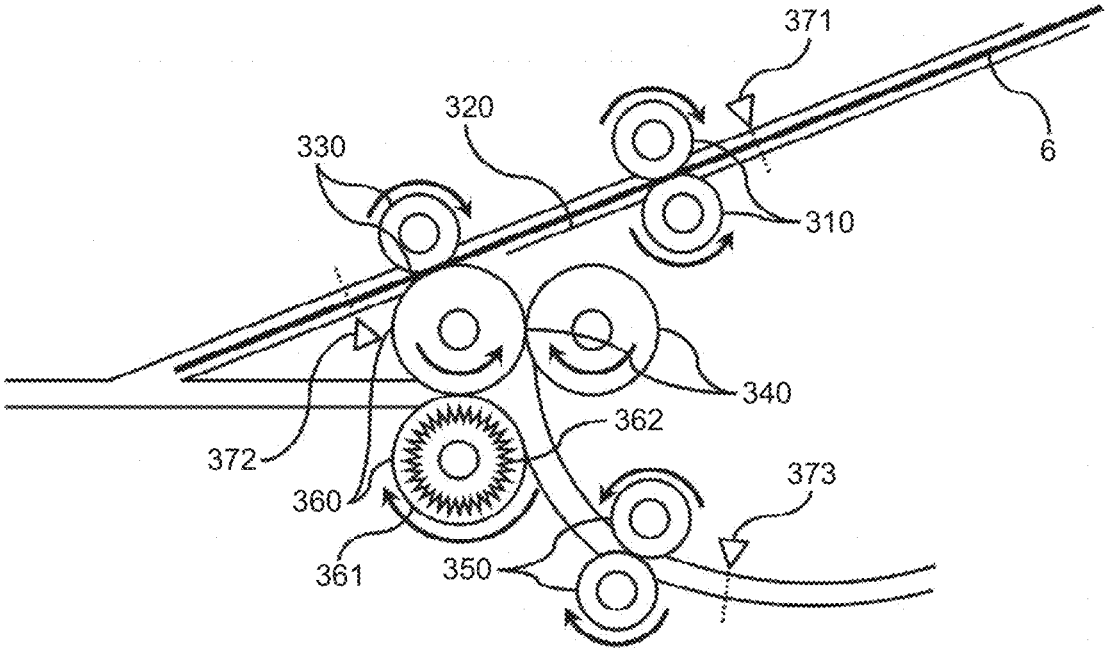
FIGS. 14A and 14B are diagrams illustrating procedures when the user removes the sheet stopped in the through mode of the folding processing unit according to the embodiment of the present invention.
Figure 14B:
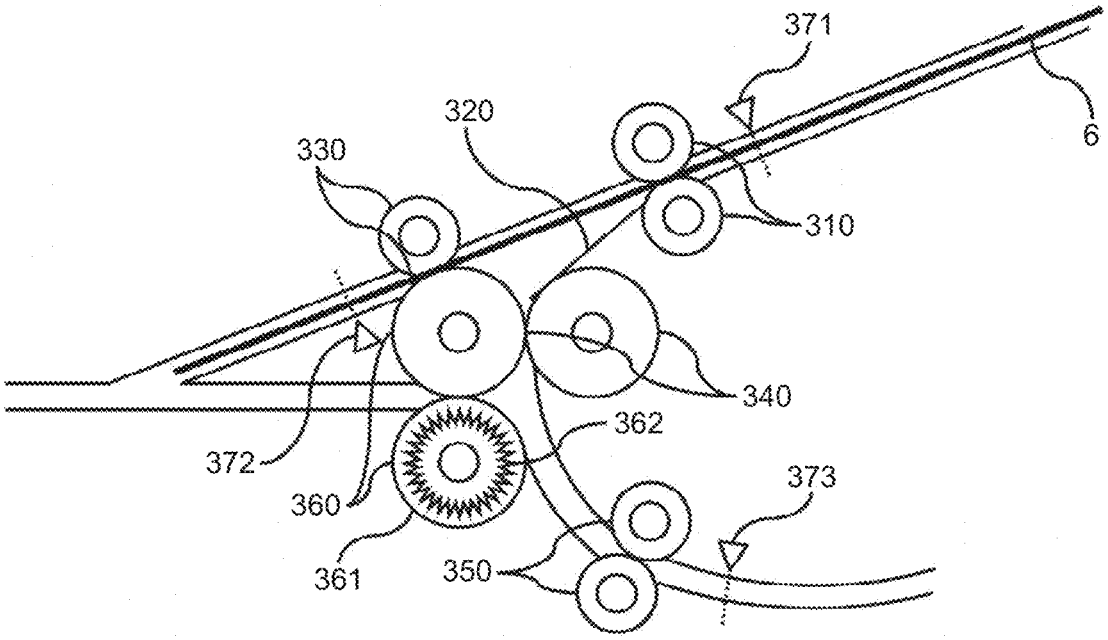

Next, a description will be made regarding procedures when the user removes the sheet 6 in a case where the conveyance of the sheet 6 is stopped due to the generation of the abnormality when the folding processing unit 3 according to the embodiment is in the through mode with reference to FIGS. 14A and 14B. FIGS. 14A and 14B are diagrams illustrating the procedures when the user removes the sheet 6 in a case where the conveyance of the sheet 6 is stopped due to the generation of the abnormality when the folding processing unit 3 according to the embodiment is in the through mode.

In a case where the folding processing unit 3 according to the embodiment is in the through mode, as illustrated in FIG. 14A, the bifurcating claw 320 is in the closed state with respect to the first folding processing roller pair 340. Thus, in a case where the abnormality is generated in the through mode, the folding processing unit 3 according to the embodiment shifts the bifurcating claw 320 from the closed state to the opened state with respect to the first folding processing roller pair 340, and then, stops the conveyance of the sheet 6 as illustrated in FIG. 14B.

In this manner, even in a case where the conveyance of the sheet 6 is stopped in the through mode, the folding processing unit 3 according to the embodiment reaches the same state as the state in which the conveyance of the sheet 6 is stopped in the folding mode, by shifting the bifurcating claw 320 from the closed state to the opened state with respect to the first folding processing roller pair 340.

Thereafter, the same procedures described with reference to FIGS. 11A to 13C are applied. As a result, the sheet 6 is ejected in the state in which it is folded.

Furthermore, either in the folding mode or the through mode, the folding processing unit 3 according to the embodiment may be configured to stop after shifting the bifurcating claw 320 from the closed state to the opened state with respect to the first folding processing roller pair 340 in the case where the conveyance of the sheet 6 is stopped in a state in which the sheet 6 is nipped by the first forward and reverse rotation roller pair 330.

At this time, the folding processing unit 3 according to the embodiment determines whether the sheet 6 is nipped by the first forward and reverse rotation roller pair 330 by determining whether the sheet 6 is conveyed as much as a predetermined number of pulses after the leading end of the sheet 6 in the conveying direction is detected by the first sheet detection sensor 371. Alternatively, the folding processing unit 3 according to the embodiment determines whether the sheet 6 is nipped by the first forward and reverse rotation roller pair 330 by determining whether the leading end of the sheet 6 in the conveying direction is detected by the second sheet detection sensor 372.

In this manner, according to the folding processing unit 3 according to the embodiment, even in a case where the conveyance of the sheet 6 is stopped due to the generation of the abnormality in the through mode, the user can easily remove the sheet 6 only by rotating the first rotation knob 362.

Figure 15:
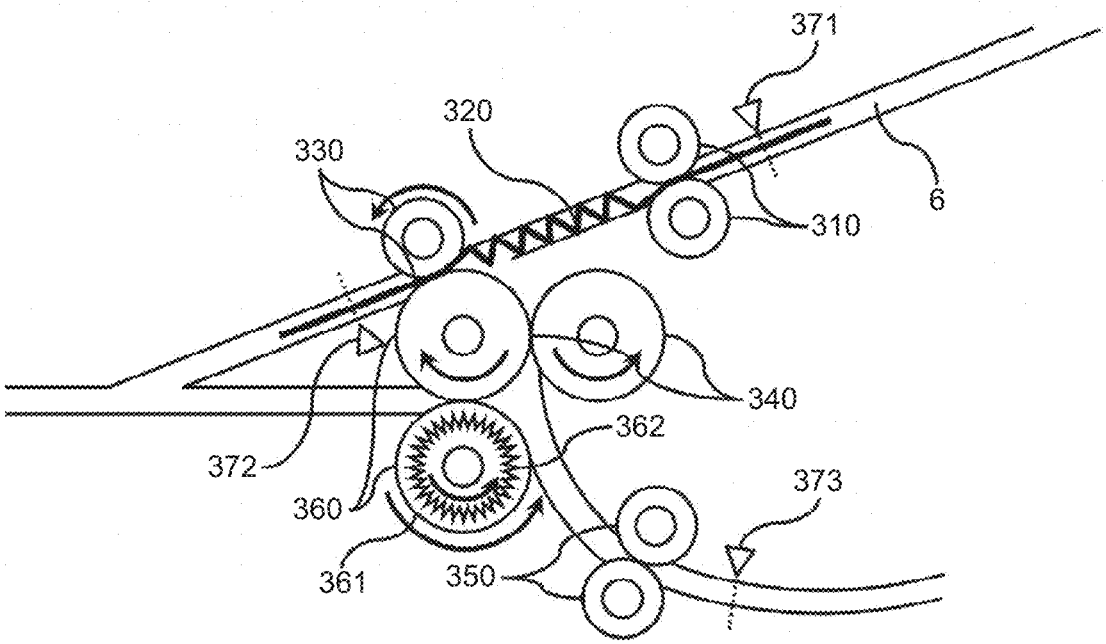
FIG. 15 is a diagram for describing a phenomenon occurring when the conveyance of the sheet is stopped with a bifurcating claw remaining at an original state at the time of the through mode of the folding processing unit according to the embodiment of the present invention.

Furthermore, if the first rotation knob 362 is rotated still in a state where the bifurcating claw 320 is closed with respect to the first folding processing roller pair 340, there is no place to escape for the sheet 6. As a result, the sheet 6 is deformed in a shape like a bellows between the inlet conveying roller pair 310 and the first forward and reverse rotation roller pair 330 as illustrated in FIG. 15, and thus, it becomes difficult to remove the sheet 6.

Thus, in the through mode, the folding processing unit 3 according to the embodiment is configured to stop the conveyance of the sheet 6 after shifting the bifurcating claw 320 from the closed state to the opened state with respect to the first folding processing roller pair 340 as illustrated in FIG. 14B.

Next, a description will be made regarding stopped positions of the sheet 6 in the folding processing unit 3 according to the embodiment and a removal method in each stopped position of the sheet 6 with reference to FIGS. 16A to 19.

Figure 16A:
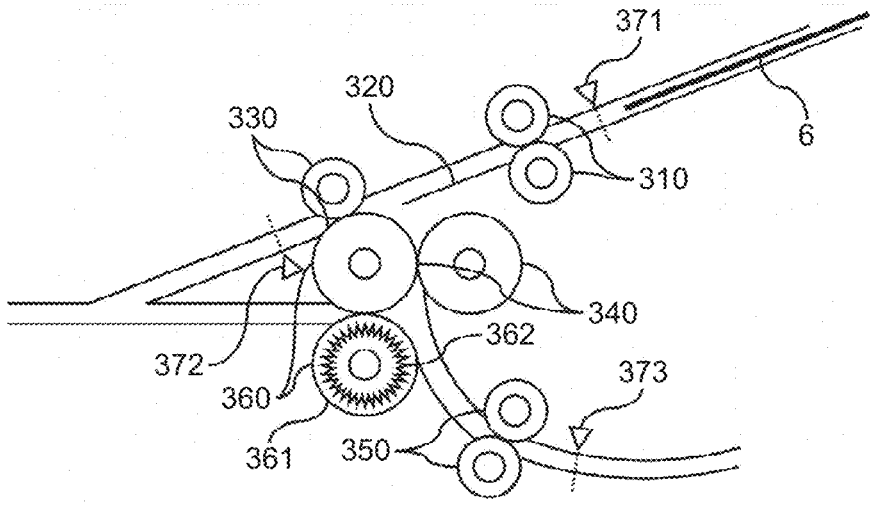
FIGS. 16A to 16C are diagrams for describing a method by which the user removes the sheet when the conveyance of the sheet is stopped in the folding processing unit according to the embodiment of the present invention.
Figure 16B:
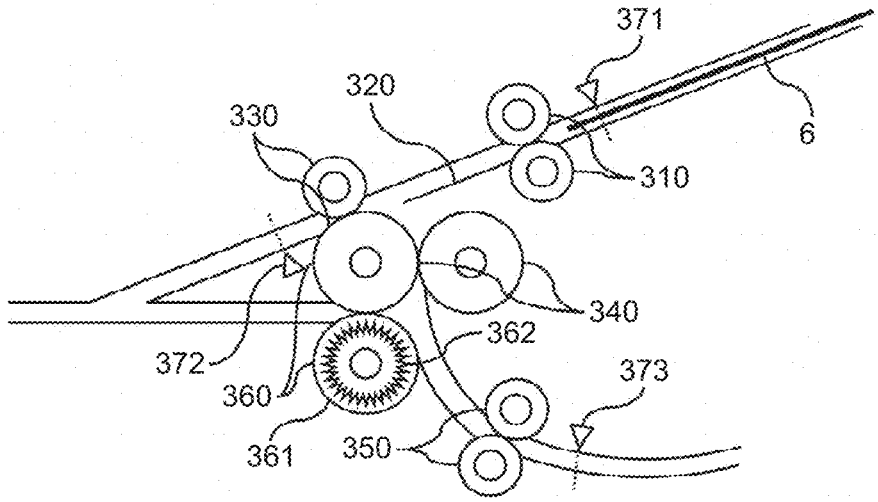
Figure 16C:
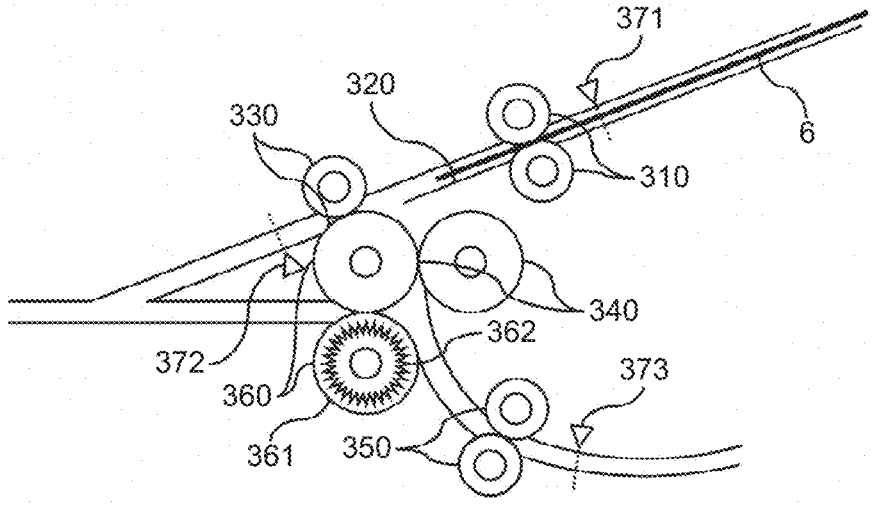

First, a description will be made regarding a case where the conveyance of the sheet 6 is stopped in the state where it is not sandwiched by the first forward and reverse rotation roller pair 330 as illustrated in FIGS. 16A to 16C. FIGS. 16A to 16C are diagrams for describing the method by which the user removes the sheet 6 in a case where the folding processing unit 3 according to the embodiment stops the conveyance of the sheet 6 due to the generation of the abnormality.

In such a case, the sheet 6 is not sandwiched by the first forward and reverse rotation roller pair 330, and thus, is not removed even when the first rotation knob 362 rotates. Thus, in such a case, the user cannot remove the sheet 6 even by rotating the first rotation knob 362. Accordingly, in such a case, the user may simply withdraw the sheet 6 from the upstream in the conveying direction.

Furthermore, at this time, the sheet 6 is removed by being withdrawn from the upstream in the conveying direction as described above, and thus, the bifurcating claw 320 may remain in the closed state with respect to the first folding processing roller pair 340.

Figure 17A:
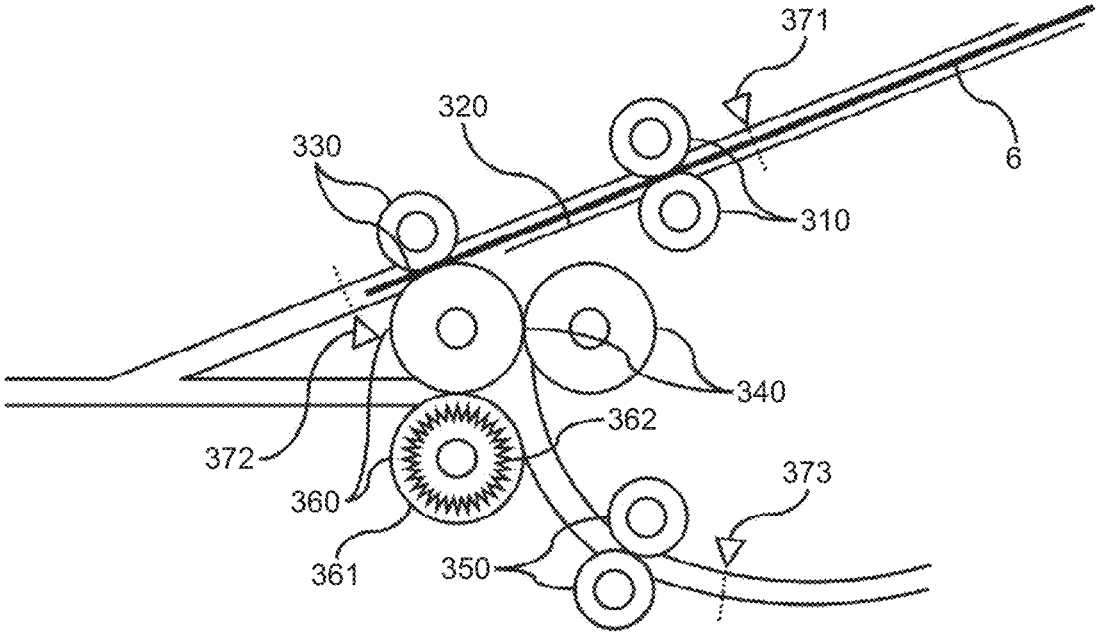
FIGS. 17A and 17B are diagrams for describing the method by which the user removes the sheet when the conveyance of the sheet is stopped in the folding processing unit according to the embodiment of the present invention.
Figure 17B:
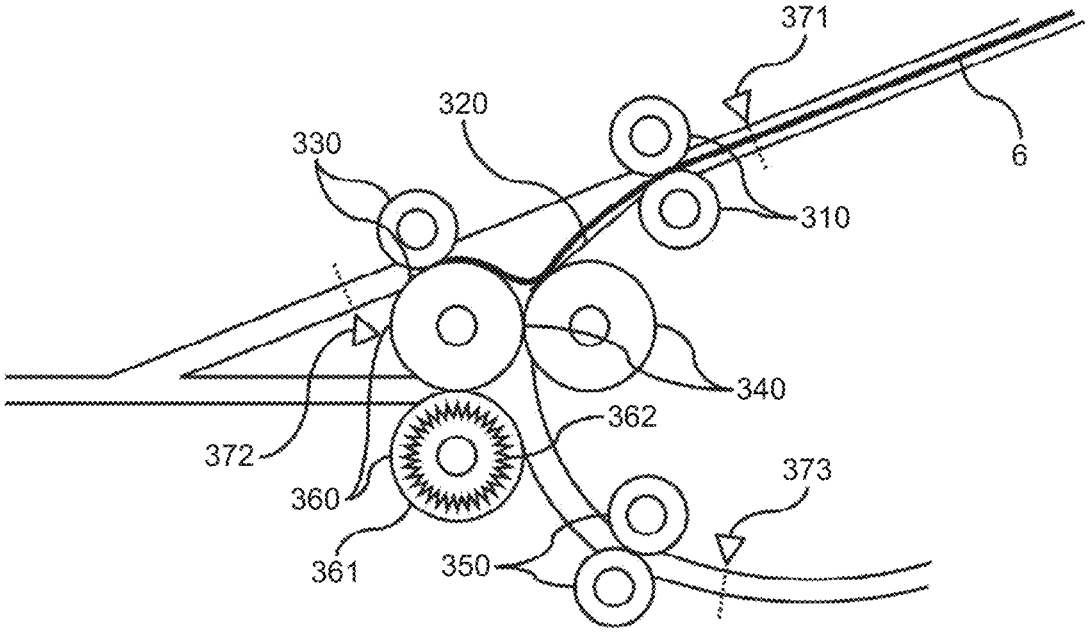

Next, a description will be made regarding a case where the conveyance of the sheet 6 is stopped in the state in which it is sandwiched by the first forward and reverse rotation roller pair 330 although the leading end of the sheet 6 is not detected by the second sheet detection sensor 372 as illustrated in FIG. 17A. FIGS. 17A and 17B are diagrams for describing the method by which the user removes the sheet 6 in a case where the folding processing unit 3 according to the embodiment stops the conveyance of the sheet 6 due to the generation of the abnormality.

In such a case, the sheet 6 is sandwiched by the first forward and reverse rotation roller pair 330, but the leading end thereof escapes from the first forward and reverse rotation roller pair 330 before the formed deflection is sandwiched by the nipping portion of the second folding processing roller pair 360 as illustrated in FIG. 17B even when the first rotation knob 362 is rotated.

Thus, in such a case, the user cannot remove the sheet 6 even by rotating the first rotation knob 362. Accordingly, in such a case, the user may simply withdraw the sheet 6 from the upstream in the conveying direction.

Furthermore, at this time, the sheet 6 is removed by being withdrawn from the upstream in the conveying direction as described above, and thus, the bifurcating claw 320 may remain in the closed state with respect to the first folding processing roller pair 340. However, at this time, there is a possibility that the sheet 6 is removed by the rotation of the first rotation knob 362. Thus, the folding processing unit 3 may shift the bifurcating claw 320 from the closed state to the opened state with respect to the first folding processing roller pair 340 when stopping the conveyance of the sheet 6 in the state illustrated in FIG. 17A.

Figure 18A:
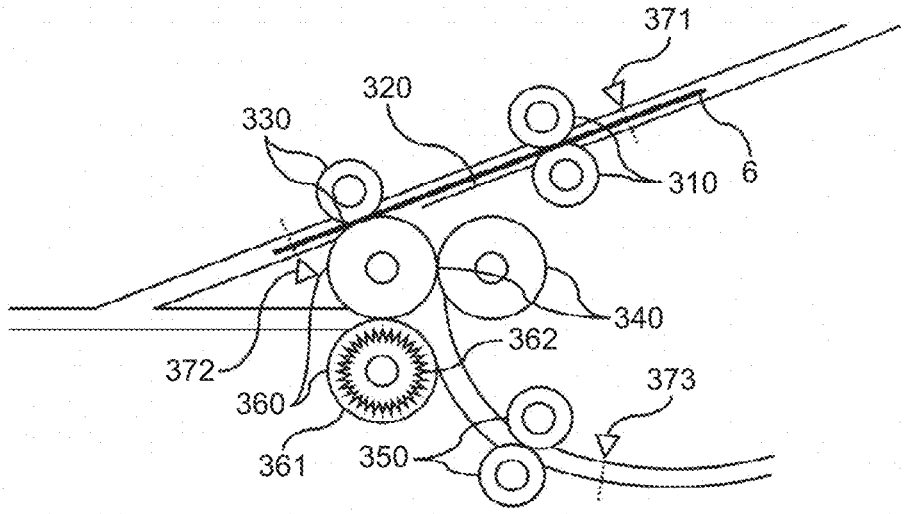
FIGS. 18A to 18C are diagrams for describing the method by which the user removes a sheet 6 when the conveyance of the sheet is stopped in the folding processing unit according to the embodiment of the present invention.
Figure 18B:
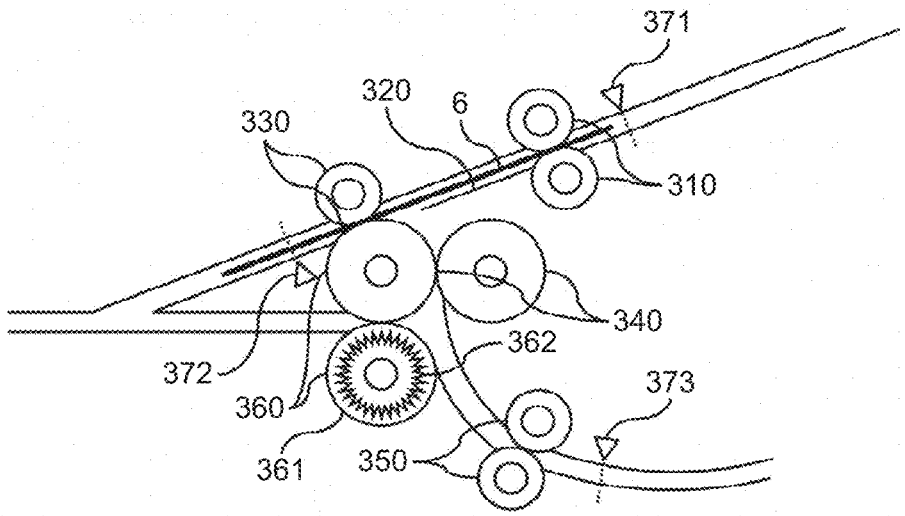
Figure 18C:
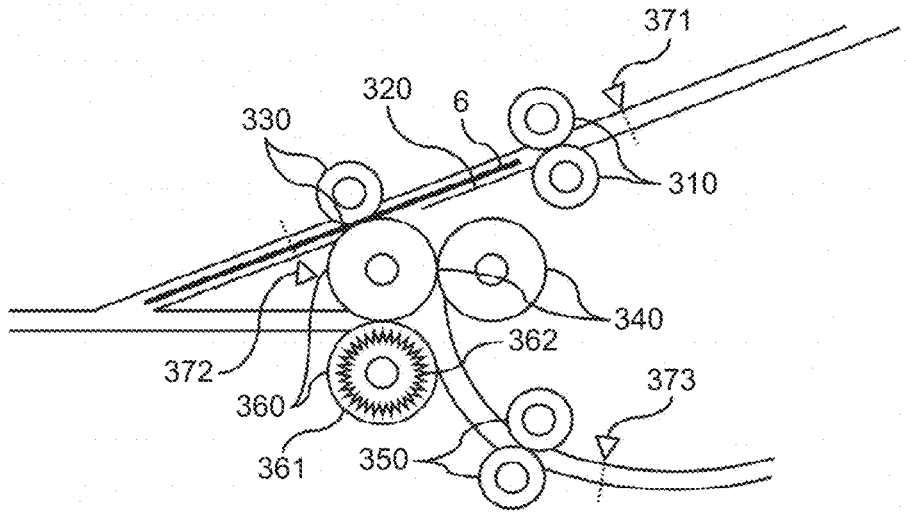

Next, a description will be made regarding a case where the conveyance of the sheet 6 is stopped in a state in which the leading end does not escape from the first forward and reverse rotation roller pair 330 before the formed deflection is sandwiched by the nipping portion of the second folding processing roller pair 360 even when the first rotation knob 362 is rotated as illustrated in FIGS. 18A to 18C. FIGS. 18A to 18C are diagrams for describing the method by which the user removes the sheet 6 in a case where the folding processing unit 3 according to the embodiment stops the conveyance of the sheet 6 due to the generation of the abnormality. In such a case, the user removes the sheet 6 according to the procedures described with reference to FIGS. 11A to 13C.

In this manner, a position of the sheet 6 that allows the sheet 6 to be removed by rotating the first rotation knob 362 is a position when being conveyed by a predetermined distance after the leading end or the trailing end of the sheet 6 in the conveying direction is detected by the first sheet detection sensor 371.

Alternatively, the position of the sheet 6 that allows the sheet 6 to be removed by rotating the first rotation knob 362 is a position when being conveyed by a predetermined distance after the leading end of the sheet 6 in the conveying direction is detected by the second sheet detection sensor 372. The predetermined distance is determined in advance depending on a size of the sheet 6 in the conveying direction, and is stored in the non-volatile storage medium such as the ROM 30 or the HDD 40.

Further, in addition to this, the position of the sheet 6 that allows the sheet 6 to be removed by rotating the first rotation knob 362 may be a position at which both the first sheet detection sensor 371 and the second sheet detection sensor 372 can detect the sheet 6. Further, in addition to this, the position of the sheet 6 that allows the sheet 6 to be removed by rotating the first rotation knob 362 may be a position at which the sheet 6 is positioned between the inlet conveying roller pair 310 and the first forward and reverse rotation roller pair 330, and the second sheet detection sensor 372 can detect the sheet 6.

Furthermore, in the embodiment, the size of the sheet 6 in the conveying direction is set to be, at least, larger than a length between the inlet conveying roller pair 310 and the first forward and reverse rotation roller pair 330. Thus, in the embodiment, the sheet 6 does not become immovable between the inlet conveying roller pair 310 and the first forward and reverse rotation roller pair 330.

Hereinafter, in such a manner, a position of the sheet 6 at the time of allowing the sheet 6 to be removed by rotating the first rotation knob 362 in a case where the folding processing unit 3 according to the embodiment stops the conveyance of the sheet 6 will be referred to as a "through mode removal position".

Figure 19:
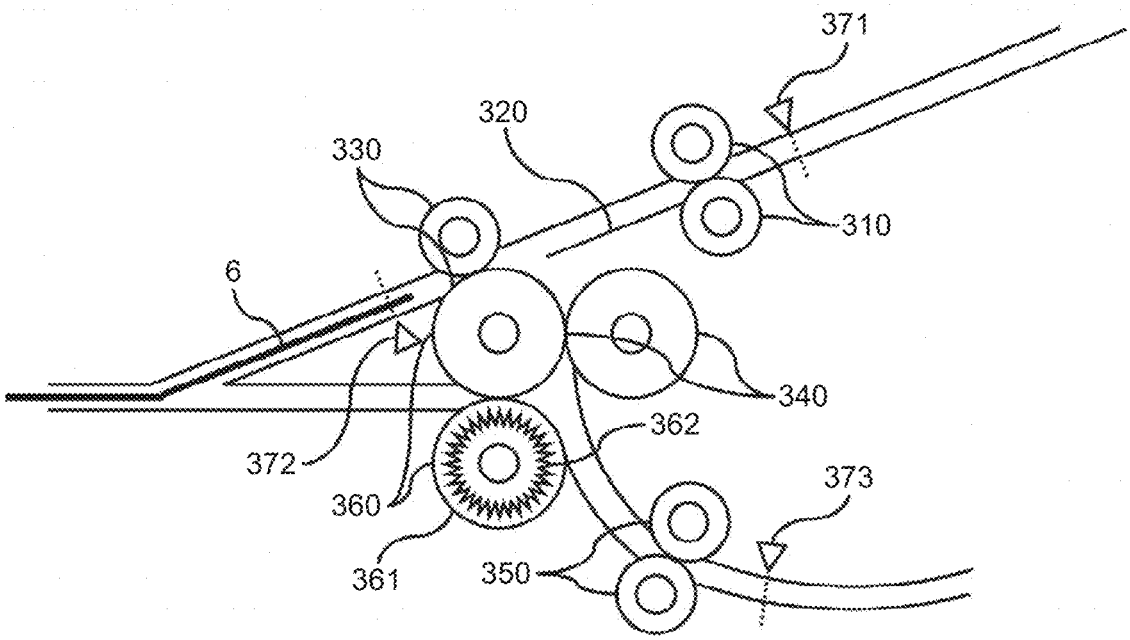
FIG. 19 is a diagram for describing the method by which the user removes a sheet 6 when the conveyance of the sheet is stopped in the folding processing unit according to the embodiment of the present invention.

Next, a description will be made regarding a case where the conveyance of the sheet 6 is stopped in the state in which it is not sandwiched by the first forward and reverse rotation roller pair 330 as illustrated in FIG. 19. FIG. 19 is a diagram for describing the method by which the user removes the sheet 6 in a case where the folding processing unit 3 according to the embodiment stops the conveyance of the sheet 6 due to the generation of the abnormality.

In such a case, the sheet 6 is not sandwiched by the first forward and reverse rotation roller pair 330, and thus, is not removed even when the first rotation knob 362 rotates. Thus, in such a case, the user cannot remove the sheet 6 even by rotating the first rotation knob 362. Accordingly, in such a case, the user may simply withdraw the sheet 6 from the downstream in the conveying direction.

Furthermore, at this time, since the sheet 6 is removed by being withdrawn from the downstream in the conveying direction as described above, the bifurcating claw 320 may remain in the closed state with respect to the first folding processing roller pair 340.

In this manner, in a case where the conveyance of the sheet 6 is stopped in the folding processing unit 3 according to the embodiment, the user can remove the sheet 6 by a suitable method depending on the stopped position.

Figure 20:
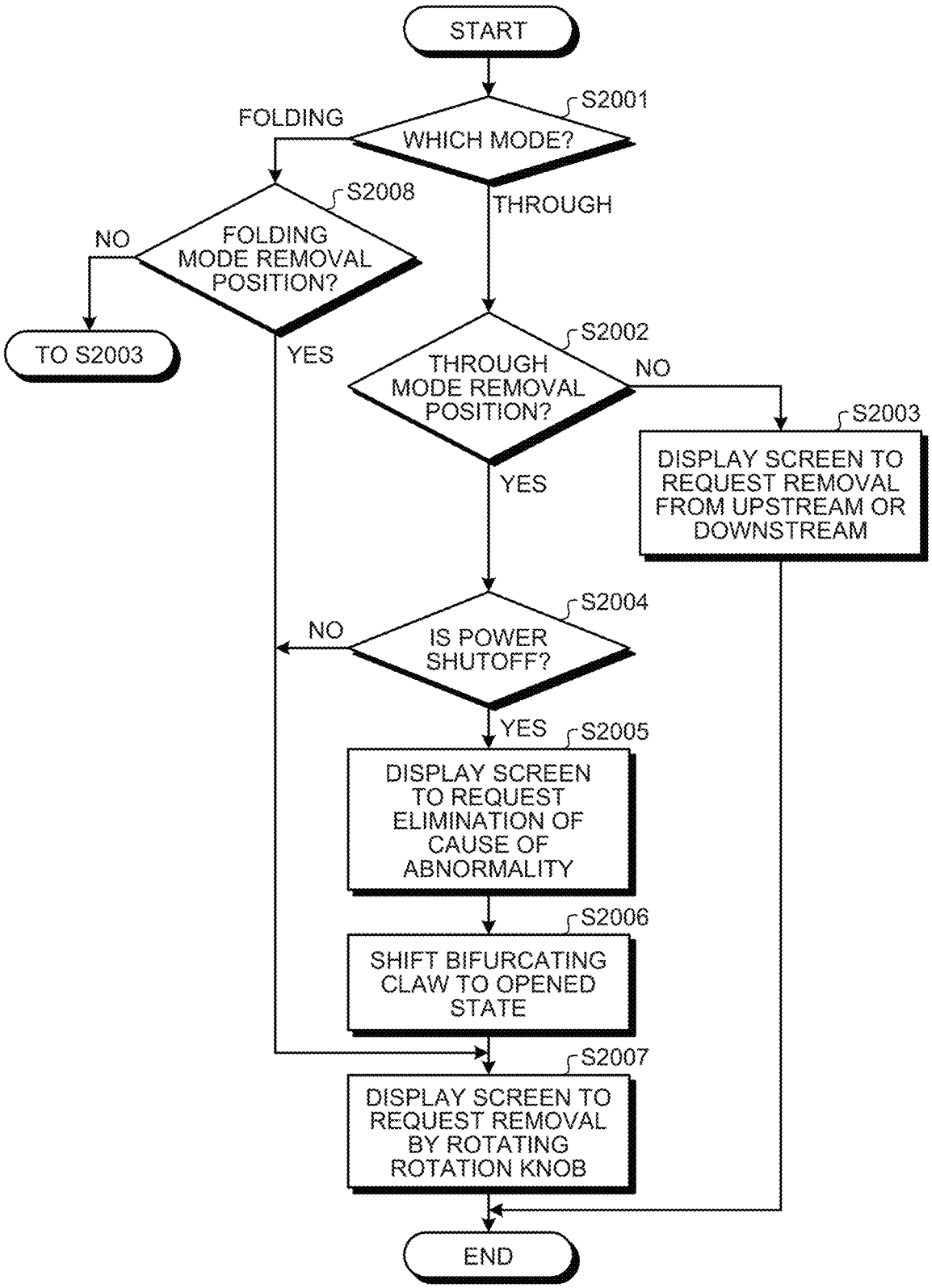
FIG. 20 is a flowchart for describing a process when the folding processing unit according to the embodiment of the present invention stops the conveyance of the sheet due to generation of an abnormality.

Next, a description will be made regarding a process when the folding processing unit 3 according to the embodiment stops the conveyance of the sheet 6 due to the generation of the abnormality with reference to FIG. 20. FIG. 20 is a flowchart for describing the process when the folding processing unit 3 according to the embodiment stops the conveyance of the sheet 6 due to the generation of the abnormality.

It is noted that the folding processing unit 3 according to the embodiment generates an abnormality in a case where it is difficult to detect the leading end of the sheet 6 in the conveying direction by the second sheet detection sensor 372 although a predetermined time elapses after the leading end of the sheet 6 in the conveying direction is detected by the first sheet detection sensor 371. The predetermined time is set to be, at least, longer than a time required for the sheet 6 to pass through the first sheet detection sensor 371. Alternatively, the predetermined time may be set to be, at least, longer than a time required for the leading end of the sheet 6 in the conveying direction to pass through the second sheet detection sensor 372 after passing through the first sheet detection sensor 371.

The folding processing unit 3 according to the embodiment first determines whether a current mode is the folding mode or the through mode when the conveyance of the sheet 6 is stopped due to the generation of the abnormality (S2001).

In a case where it is determined that the current mode is the through mode in the determination process of S2001 (THROUGH in S2001), the folding processing unit 3 determines whether the sheet 6 is in the through mode removal position (S2002).

In a case where it is determined that the sheet 6 is not in the through mode removal position in the determination process of S2002 (NO in S2002), the folding processing unit 3 displays a screen prompting the user to remove the sheet 6 from the upstream in the conveying direction or the downstream in the conveying direction on the display panel 600 (S2003). Further, in a case where the sheet 6 is removed, the folding processing unit 3 ends the process when the conveyance of the sheet 6 is stopped due to the generation of the abnormality.

Meanwhile, in a case where it is determined that the sheet 6 is in the through mode removal position in the determination process of S2002 (YES in S2002), the folding processing unit 3 determines whether the generated abnormality is an abnormality caused by shutoff of power to a drive system, such as the opening of the cover (S2004).

In a case where it is determined that the generated abnormality is the abnormality caused by the shutoff of power to the drive system in the determination process of S2004 (YES in S2004), the folding processing unit 3 displays a screen prompting the user to eliminate the cause of the abnormality, for example, to close the cover or the like, on the display panel 600 (S2005). At this time, since the power to the drive system is shutoff, the folding processing unit 3 is in the state in which it is incapable of shifting the bifurcating claw 320 to the opened state with respect to the first folding processing roller pair 340.

In a case where the cause of the abnormality is eliminated, the folding processing unit 3 restores power supply by starting the supply of power to the drive system, and shifts the bifurcating claw 320 to the opened state with respect to the first folding processing roller pair 340 (S2006).

In a case where the bifurcating claw 320 is shifted as described above, the folding processing unit 3 displays a screen prompting the user to remove the sheet 6 by rotating the first rotation knob 362 on the display panel 600 (S2007). Further, in a case where the sheet 6 is removed, the folding processing unit 3 ends the process when the conveyance of the sheet 6 is stopped due to the generation of the abnormality.

Meanwhile, in a case where it is determined that the generated abnormality is not the abnormality caused by the shutoff of power to the drive system in the determination process of S2004 (NO in S2004), the folding processing unit 3 displays the screen prompting the user to remove the sheet 6 by rotating the first rotation knob 362 on the display panel 600 (S2007). Further, in a case where the sheet 6 is removed, the folding processing unit 3 ends the process when the conveyance of the sheet 6 is stopped due to the generation of the abnormality.

On the other hand, in a case where it is determined that the current mode is the folding mode in the determination process of S2001 (FOLDING in S2001), the folding processing unit 3 determines whether the sheet 6 is in the folding mode removal position (S2008).

In a case where it is determined that the sheet 6 is not in the through mode removal position in the determination process of S2008 (NO in S2002), the folding processing unit 3 displays the screen prompting the user to remove the sheet 6 from the upstream in the conveying direction or the downstream in the conveying direction on the display panel 600 (S2009). Further, in a case where the sheet 6 is removed, the folding processing unit 3 ends the process when the conveyance of the sheet 6 is stopped due to the generation of the abnormality.

Meanwhile, in a case where it is determined that the sheet 6 is in the through mode removal position in the determination process of S2008 (YES in S2008), the folding processing unit 3 displays the screen prompting the user to remove the sheet 6 by rotating the first rotation knob 362 on the display panel 600 (S2003). Further, in a case where the sheet 6 is removed, the folding processing unit 3 ends the process when the conveyance of the sheet 6 is stopped due to the generation of the abnormality.

As described above, the folding processing unit 3 according to the embodiment includes the first rotation knob 362, which is rotated so as to rotate the second folding processing roller pair 360 in a direction of the rotation when the sheet 6 is conveyed in conjunction with the rotation thereof, as one of the points. Accordingly, even in a case where the folding processing unit 3 stops the conveyance of the sheet 6 at the time of the generation of the abnormality, the user can easily remove the sheet 6 by rotating the first rotation knob 362.

Furthermore, in the embodiment, the description has been made regarding a case where the sheet 6 is stopped in the folding processing unit 3, but the same can be applied to a case where the sheet 6 is stopped in the image forming unit 2 or the post-processing unit 4 by providing the first rotation knob 362 in the image forming unit 2 or the post-processing unit 4.

In addition, in the embodiment, the description has been made regarding the configuration in which the image forming unit 2, the folding processing unit 3, the post-processing unit 4 and the scanner unit 5 are provided in the image forming apparatus 1, but the configuration in which the respective units are formed as separate apparatuses different from one another, and an image forming system is formed of these apparatuses being coupled with one another may be employed.

In addition, in the embodiment, the description has been made regarding the example in which the first rotation knob 362 is configured to rotate the folding processing roller 361 in the same direction. However, the folding processing roller 361 may be rotated in the opposite direction as long as the folding processing roller 361 can be rotated in the same direction as the rotation direction when the sheet 6 is conveyed.

In addition, in the embodiment, the description has been made regarding the example in which the first rotation knob 362 is provided in the folding processing roller 361. However, the first rotation knob 362 may be provided in any part, as long as the rotational force of the first rotation knob 362 is transmitted to the folding processing roller 361, for example, via a belt or the like.

In addition, in the embodiment, the description has been made regarding the example in which the first rotation knob 362 is provided in the folding processing roller 361. However, the first rotation knob 362 may be provided in any roller included in the first forward and reverse rotation roller pair 330, the first folding processing roller pair 340 and the second folding processing roller pair 360.

In addition, the description has been made regarding the example in which the folding processing unit 3 according to the embodiment is configured to fold the sheet 6 in three, but it may be configured to perform a two-fold. In the case of being configured in such a manner, the folding processing unit 3 according to the embodiment conveys the sheet 6 from the inlet conveying roller pair 310 directly to the first folding processing roller pair 340 without conveying the sheet 6 to the first forward and reverse rotation roller pair 330. Accordingly, at this time, the bifurcating claw 320 is in the opened state with respect to the first folding processing roller pair 340.

Here, a description will be made regarding procedures when the user removes the sheet 6 in a case where the folding processing unit 3 according to the embodiment is configured in such a manner, and the conveyance of the sheet 6 is stopped due to the generation of the abnormality in the folding mode with reference to FIGS. 21A to 21D. FIGS. 21A to 21D are diagrams illustrating the procedures when the user removes the sheet 6 in a case where the folding processing unit 3 according to the embodiment stops the conveyance of the sheet 6 due to the generation of the abnormality in the folding mode.

Figure 21A:
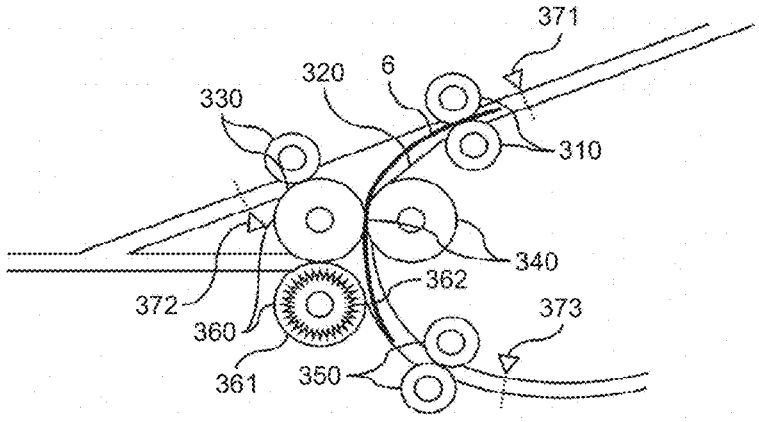
FIGS. 21A to 21D are diagrams illustrating procedures when the user removes the sheet in a case where the folding processing unit according to the embodiment of the present invention stops the conveyance of the sheet due to the generation of the abnormality in the folding mode.

As illustrated in FIG. 21A, in a case where the folding processing unit 3 according to the embodiment stops the conveyance of the sheet 6 due to the generation of the abnormality in the folding mode, first, the user manually rotates the first rotation knob 362 in the arrow direction illustrated in FIG. 22B. When the first rotation knob 362 rotates in the arrow direction illustrated in FIG. 22B, the rotational force thereof is transmitted to the folding processing roller 361. As a result, the second folding processing roller pair 360 rotates in the arrow direction illustrated in FIG. 22B in conjunction with the rotation of the first rotation knob 362.

Figure 21B:
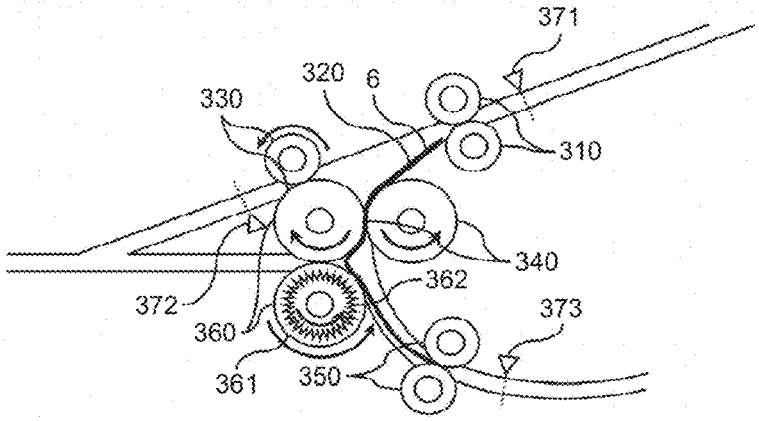

When the user rotates the first rotation knob 362 in such a state, the folding processing unit 3 further conveys the sheet 6 while causing the sheet 6 to be deflected toward the second folding processing roller pair 360 so as to guide the deflection to the nipping portion of the second folding processing roller pair 360 as illustrated in FIG. 21B.

Figure 21C:
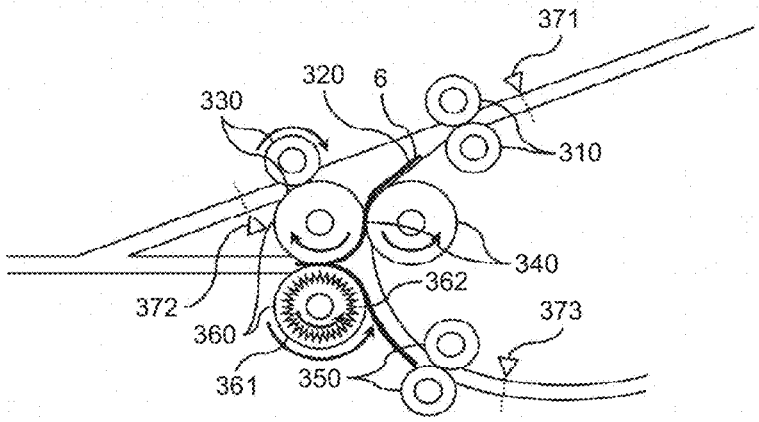
Figure 21D:
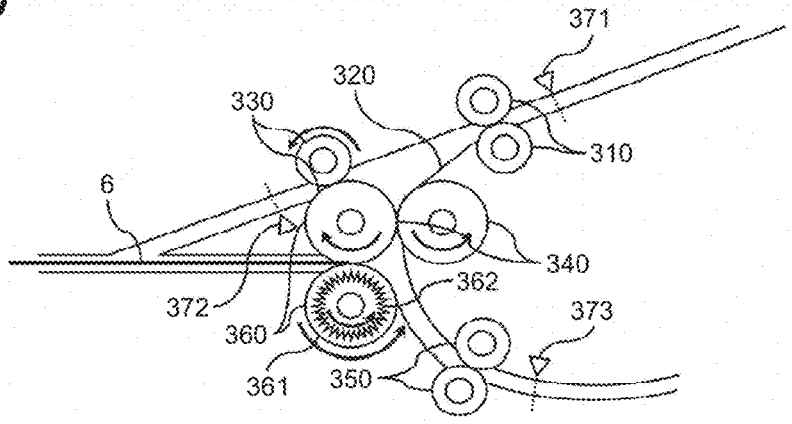

Further, when the user further rotates the first rotation knob 362, the folding processing unit 3 sandwiches the deflection formed on the sheet 6 from both sides by the nipping portion of the second folding processing roller pair 360 and forms a fold as illustrated in FIG. 21C, and further conveys the sheet 6 toward the post-processing unit 4 as illustrated in FIG. 21D. As a result, the sheet 6 is ejected in the state in which it is folded.

In this manner, according to the folding processing unit 3 according to the embodiment, even in a case where the conveyance of the sheet 6 is stopped due to the generation of the abnormality in the folding mode, the user can easily remove the sheet 6 only by rotating the first rotation knob 362.

Furthermore, in FIGS. 21A to 21D, the description has been made regarding the procedures when the sheet 6 whose conveyance is stopped at the position illustrated in FIG. 21A, is removed, but the same procedures are applied when the sheet 6 whose conveyance is stopped at each position illustrated in FIGS. 21B and 21C, is removed.

Figure 22:
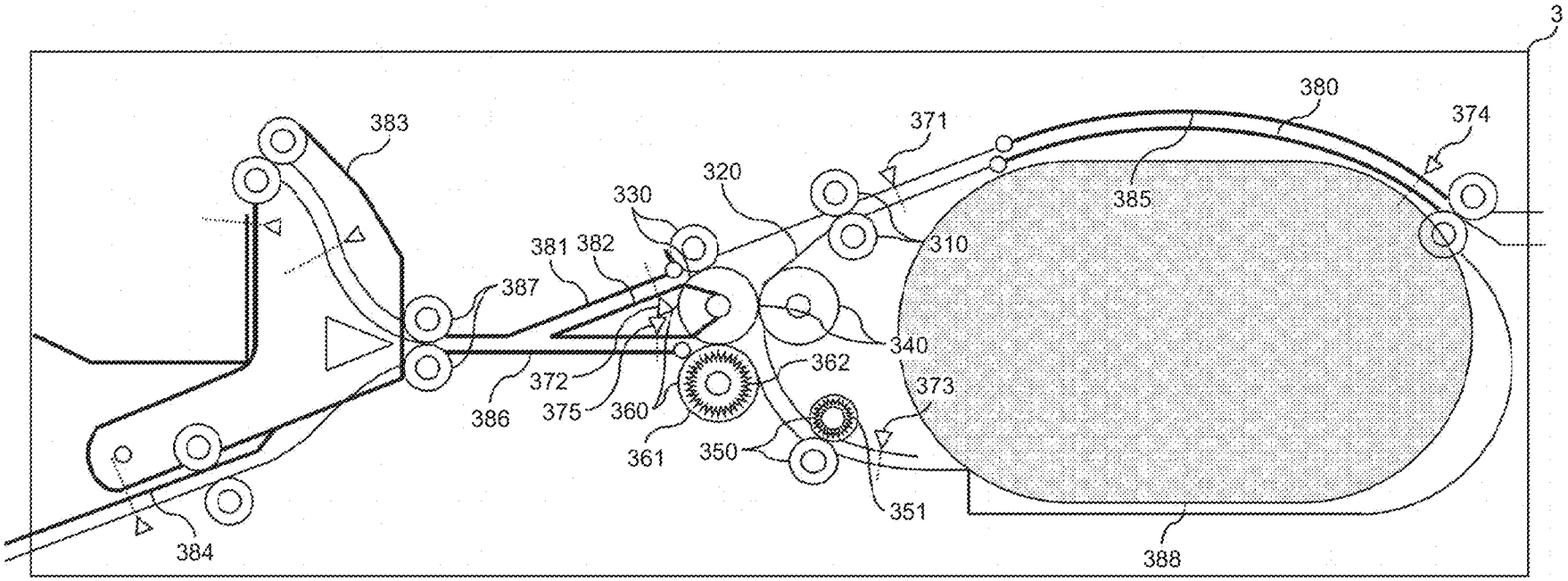
FIG. 22 is a cross-sectional view, from the main scanning direction, illustrating a processing unit according to the embodiment of the present invention.

Next, a description will be made regarding an internal configuration of the folding processing unit 3 according to the embodiment with reference to FIG. 22. FIG. 22 is a cross-sectional view, from the main scanning direction, illustrating the folding processing unit 3 according to the embodiment.

As illustrated in FIG. 22, the folding processing unit 3 according to the embodiment is provided with a second rotation knob 351, an inlet lower guide plate 380, an intermediate conveying upper guide plate 381, a fold-enhancing upper guide plate 382, a folded paper ejection unit 383, a relay paper ejection unit guide plate 384, an inlet upper guide plate 385, a fold-enhancing lower guide plate 386, a fold-enhancing roller pair 387, and a remaining sheet removing space 388.

The second rotation knob 351 is rotated to rotate the second folding processing roller pair 360 in conjunction with the rotation thereof. That is, in the embodiment, the second rotation knob 351 functions as a second rotation unit. The inlet lower guide plate 380 and the inlet upper guide plate 385 guide the sheet, which has been conveyed from the image forming unit 2, to the inlet conveying roller pair 310. That is, in the embodiment, the inlet lower guide plate 380 functions as a third guide unit.

The intermediate conveying upper guide plate 381 and the fold-enhancing upper guide plate 382 guide the sheet conveyed downstream in the conveying direction by the first forward and reverse rotation roller pair 330, to the fold-enhancing roller pair 387 further downstream in the conveying direction. That is, in the embodiment, the intermediate conveying upper guide plate 381 functions as a second guide unit.

The fold-enhancing upper guide plate 382 and the fold-enhancing lower guide plate 386 guide the sheet conveyed downstream in the conveying direction by the second folding processing roller pair 360, further downstream in the conveying direction. That is, in the embodiment, the fold-enhancing upper guide plate 382 functions as a fourth guide unit.

The relay paper ejection unit guide plate 384 ejects the sheet outside the folding processing unit 3. The fold-enhancing roller pair 387 further presses and enhances the fold formed on the sheet folded by the first folding processing roller pair 340 or the second folding processing roller pair 360.

The remaining sheet removing space 388 is a space for allowing the user to remove the sheet ejected from the second forward and reverse roller pair 350. That is, in the embodiment, the remaining sheet removing space 388 functions as a space portion.

Next, a description will be made regarding stopped positions of the sheet 6 in the folding processing unit 3 according to the embodiment and a removal method in each stopped position of the sheet 6 with reference to FIGS. 23 to 29. FIGS. 23 to 29 are diagrams for describing the method by which the user removes the sheet 6 in a case where the folding processing unit 3 according to the embodiment stops the conveyance of the sheet 6 due to the generation of the abnormality.

Figure 23:
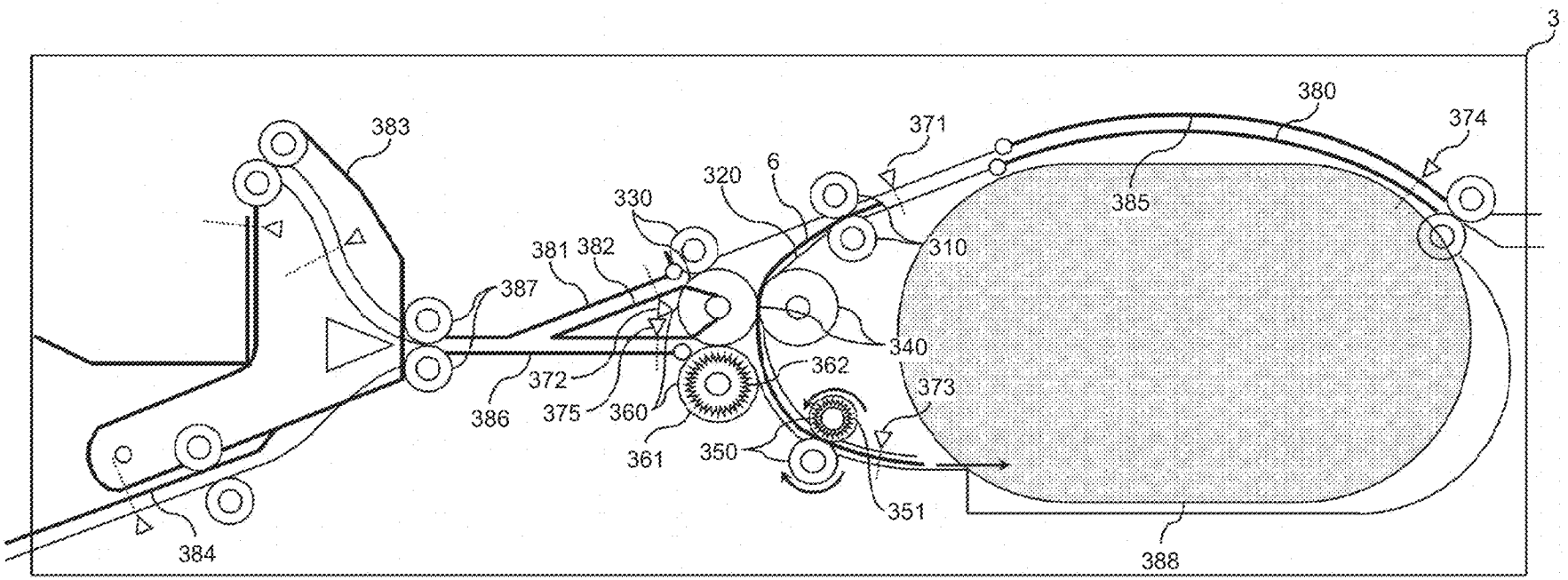
FIG. 23 is a diagram for describing the method by which the user removes the sheet when the conveyance of the sheet is stopped in the folding processing unit according to the embodiment of the present invention.

First, a description will be made regarding a case where the conveyance of the sheet 6 is stopped in a state in which the sheet 6 is detected by the third sheet detection sensor 373 as illustrated in FIG. 23. In such a case, first, the user manually rotates the second rotation knob 351 in the arrow direction illustrated in FIG. 23.

Further, when the second rotation knob 351 rotates in the arrow direction illustrated in FIG. 23, a rotational force thereof is transmitted to the second forward and reverse roller pair 350. As a result, the second forward and reverse roller pair 350 rotates in the arrow direction illustrated in FIG. 23 in conjunction with the rotation of the second rotation knob 351.

In this manner, the sheet 6 is conveyed downstream in the conveying direction, and is ejected to the remaining sheet removing space 388. Further, the user removes the sheet 6 ejected to the remaining sheet removing space 388.

In this manner, according to the folding processing unit 3 according to the embodiment, even in a case where the conveyance of the sheet 6 is stopped due to the generation of the abnormality in the folding mode, the user can easily remove the sheet 6 only by rotating the second rotation knob 351.

Figure 24:
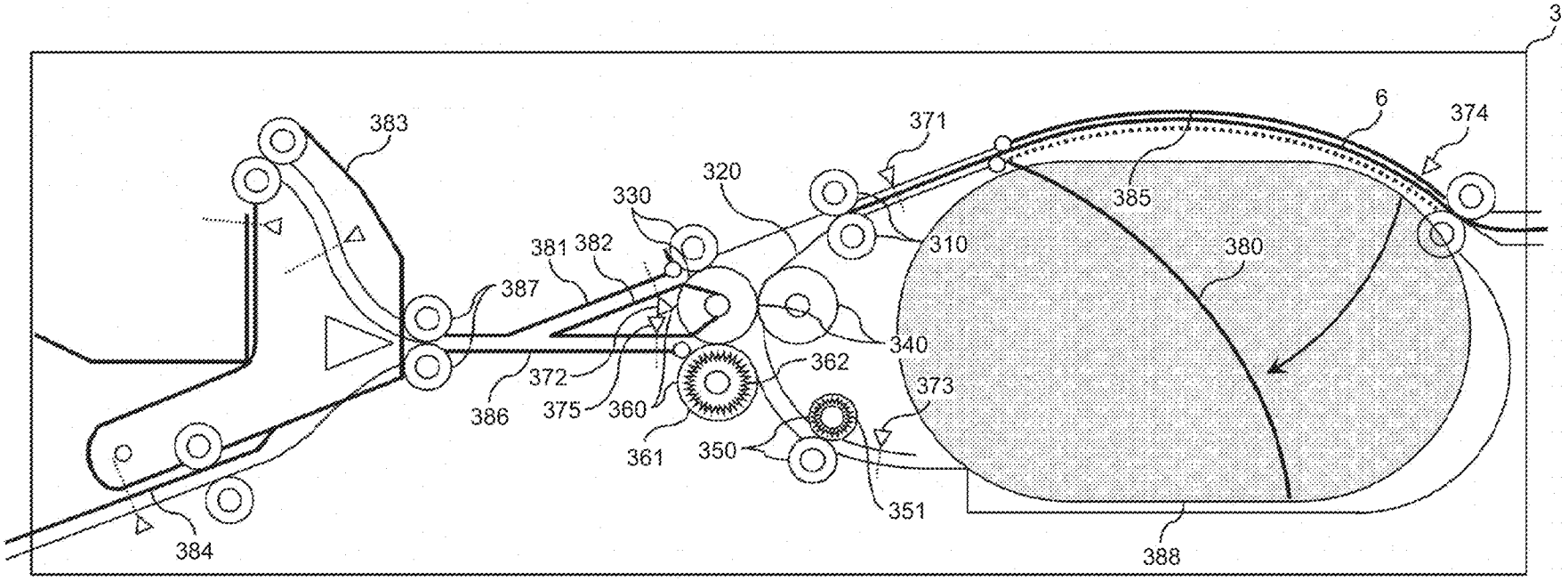
FIG. 24 is a diagram for describing the method by which the user removes the sheet when the conveyance of the sheet is stopped in the folding processing unit according to the embodiment of the present invention.
Figure 25:
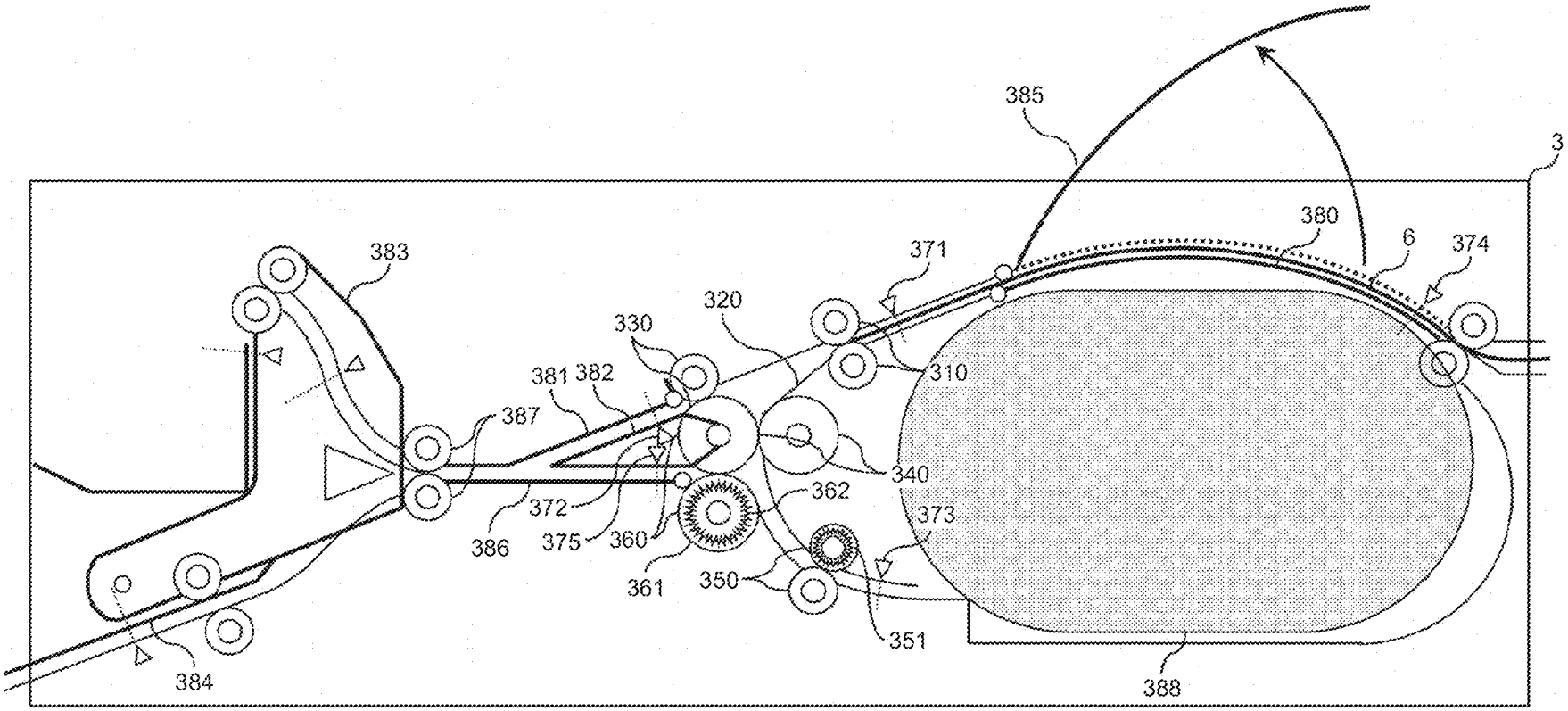
FIG. 25 is a diagram for describing the method by which the user removes the sheet when the conveyance of the sheet is stopped in the folding processing unit according to the embodiment of the present invention.

Next, a description will be made regarding a case in which the sheet 6, which has been conveyed from the image forming unit 2, is stopped in the middle of being conveyed to the inlet conveying roller pair 310 as illustrated in FIGS. 24 and 25.

In such a case, the user removes the sheet 6 by opening the inlet lower guide plate 380 in the arrow direction, that is, toward the remaining sheet removing space 388 as illustrated in FIG. 24. Alternatively, in such a case, the user removes the sheet 6 by opening the inlet upper guide plate 385 in the arrow direction, that is, opposite to the remaining sheet removing space 388 as illustrated in FIG. 25.

It is noted that the folding processing unit 3 according to the embodiment detects that the sheet 6, which has been conveyed from the image forming unit 2, is stopped in the middle of being conveyed to the inlet conveying roller pair 310 by the first sheet detection sensor 371 or a fourth sheet detection sensor 374.

Figure 26:
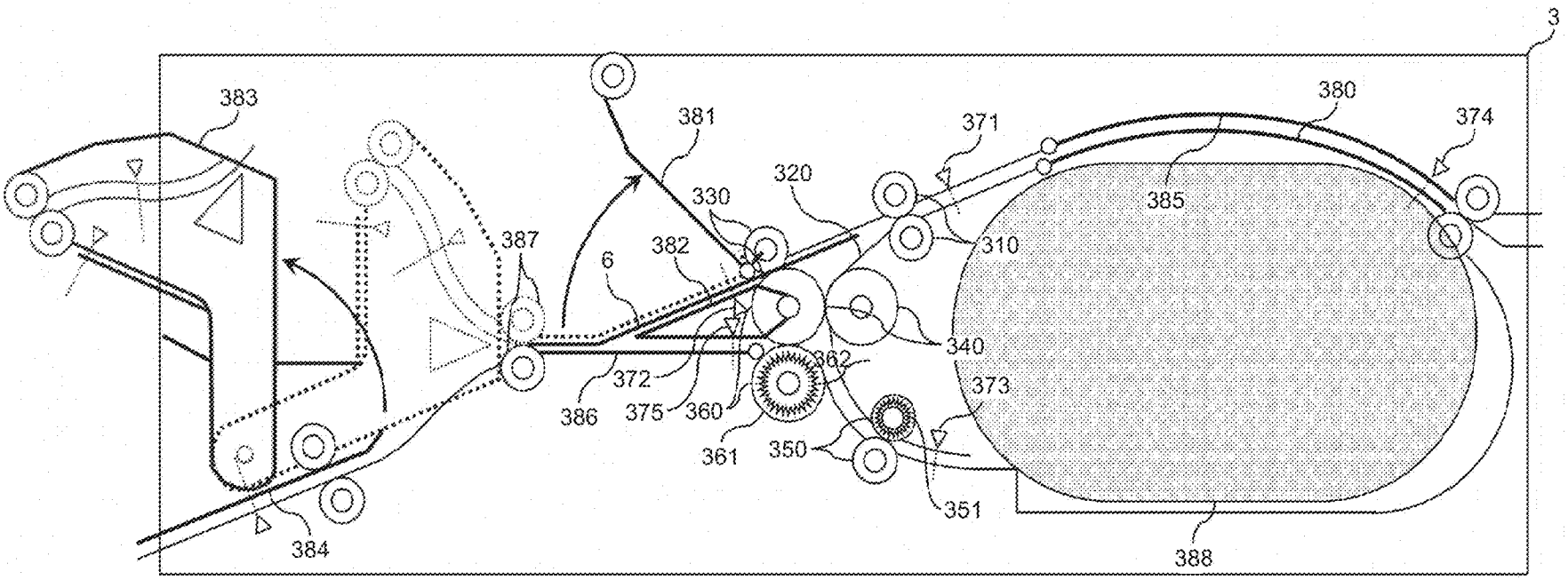
FIG. 26 is a diagram for describing the method by which the user removes the sheet when the conveyance of the sheet is stopped in the folding processing unit according to the embodiment of the present invention.
Figure 27:
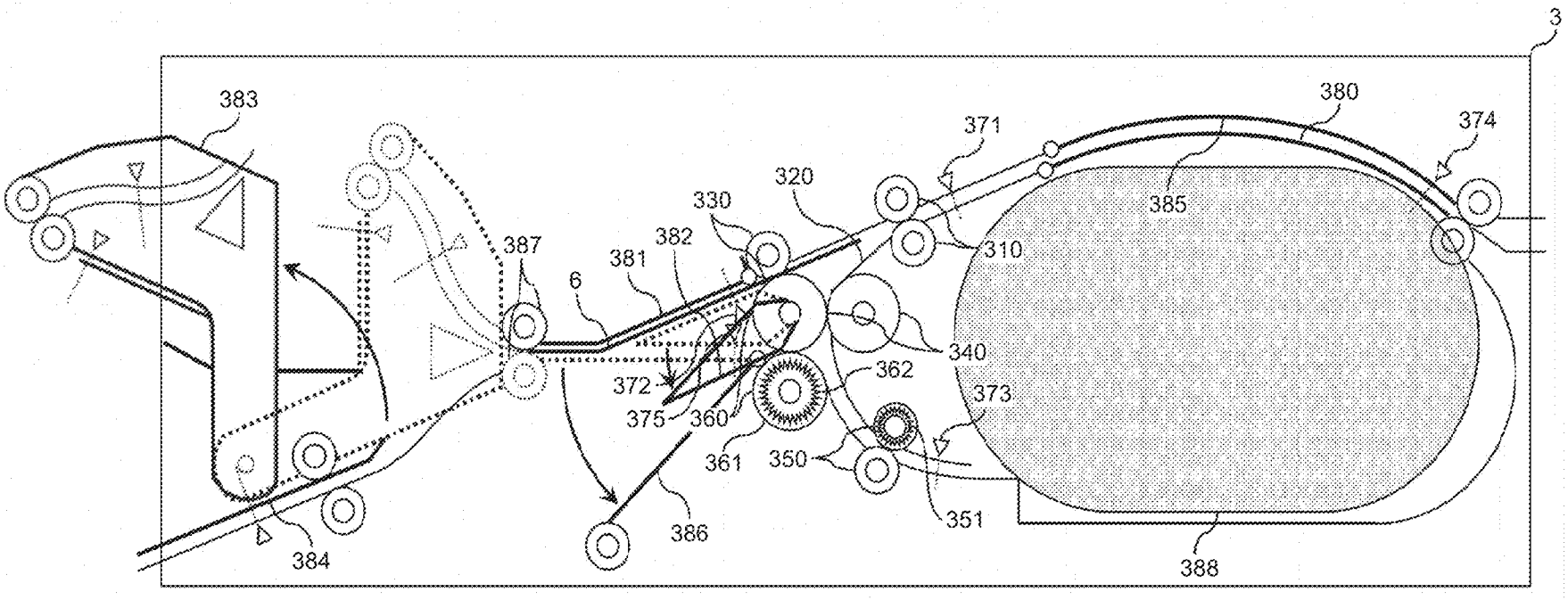
FIG. 27 is a diagram for describing the method by which the user removes the sheet when the conveyance of the sheet is stopped in the folding processing unit according to the embodiment of the present invention.

Next, a description will be made regarding a case where the sheet 6 is stopped between the first forward and reverse rotation roller pair 330 and the fold-enhancing roller pair 387 as illustrated in FIGS. 26 and 27.

In such a case, the user removes the sheet 6 by opening the folded paper ejection unit 383 in the arrow direction, that is, upwardly, and then, opening the intermediate conveying upper guide plate 381 in the arrow direction, that is, upwardly as illustrated in FIG. 26.

Alternatively, in such a case, the user removes the sheet 6 by opening the intermediate conveying upper guide plate 381 in the arrow direction, that is, upwardly, and then, opening the fold-enhancing upper guide plate 382 and the fold-enhancing lower guide plate 386 in the arrow direction, that is, downwardly as illustrated in FIG. 27.

It is noted that a handle for opening and closing the folded paper ejection unit 383 is attached to an exterior portion of the folded paper ejection unit 383, and accordingly, the user can easily open and close the folded paper ejection unit 383.

In addition, the folding processing unit 3 according to the embodiment is configured such that the intermediate conveying upper guide plate 381 can be opened and closed in a state in which the folded paper ejection unit 383 is opened, but may be configured such that the intermediate conveying upper guide plate 381 can be opened and closed regardless of the opened or closed state of the folded paper ejection unit 383.

In addition, the folding processing unit 3 according to the embodiment is configured such that the fold-enhancing upper guide plate 382 and the fold-enhancing lower guide plate 386 can be opened and closed in a state in which the folded paper ejection unit 383 is opened, but may be configured such that the fold-enhancing upper guide plate 382 and the fold-enhancing lower guide plate 386 can be opened and closed regardless of the opened or closed state of the folded paper ejection unit 383.

It is noted that the folding processing unit 3 according to the embodiment detects that the sheet 6 is stopped between the first forward and reverse rotation roller pair 330 and the fold-enhancing roller pair 387 by the second sheet detection sensor 372.

Figure 28:
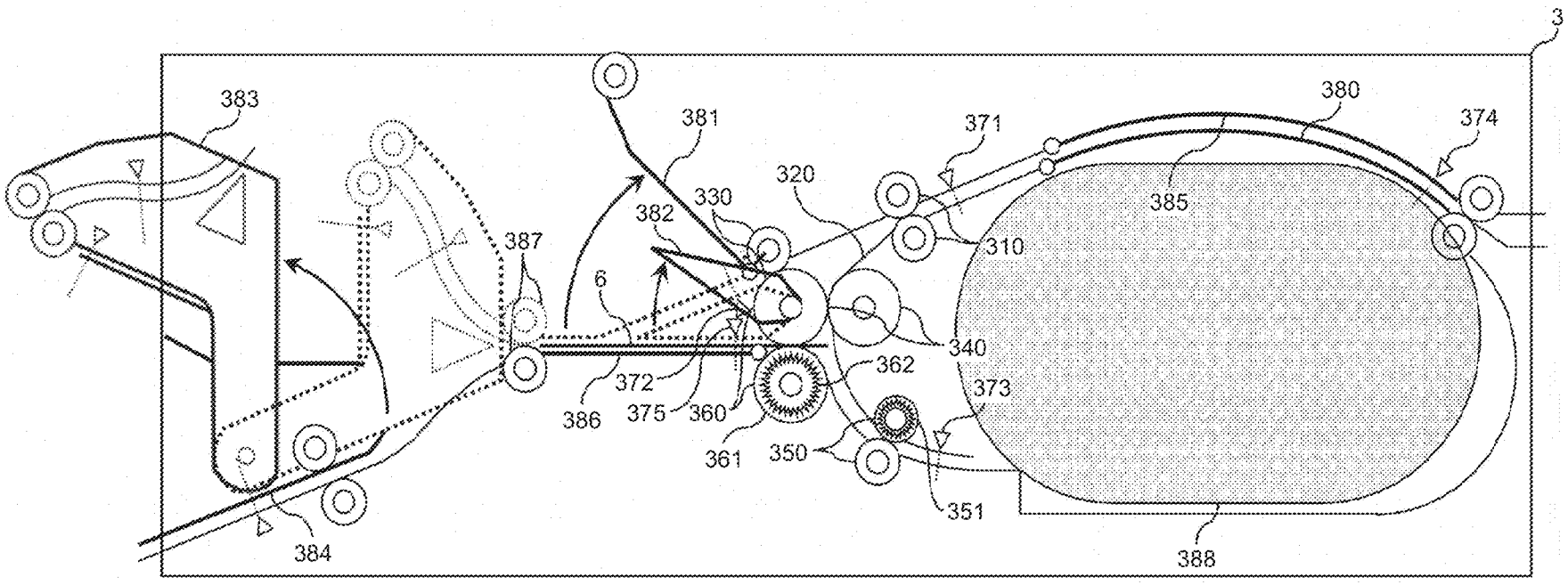
FIG. 28 is a diagram for describing the method by which the user removes the sheet when the conveyance of the sheet is stopped in the folding processing unit according to the embodiment of the present invention.
Figure 29:
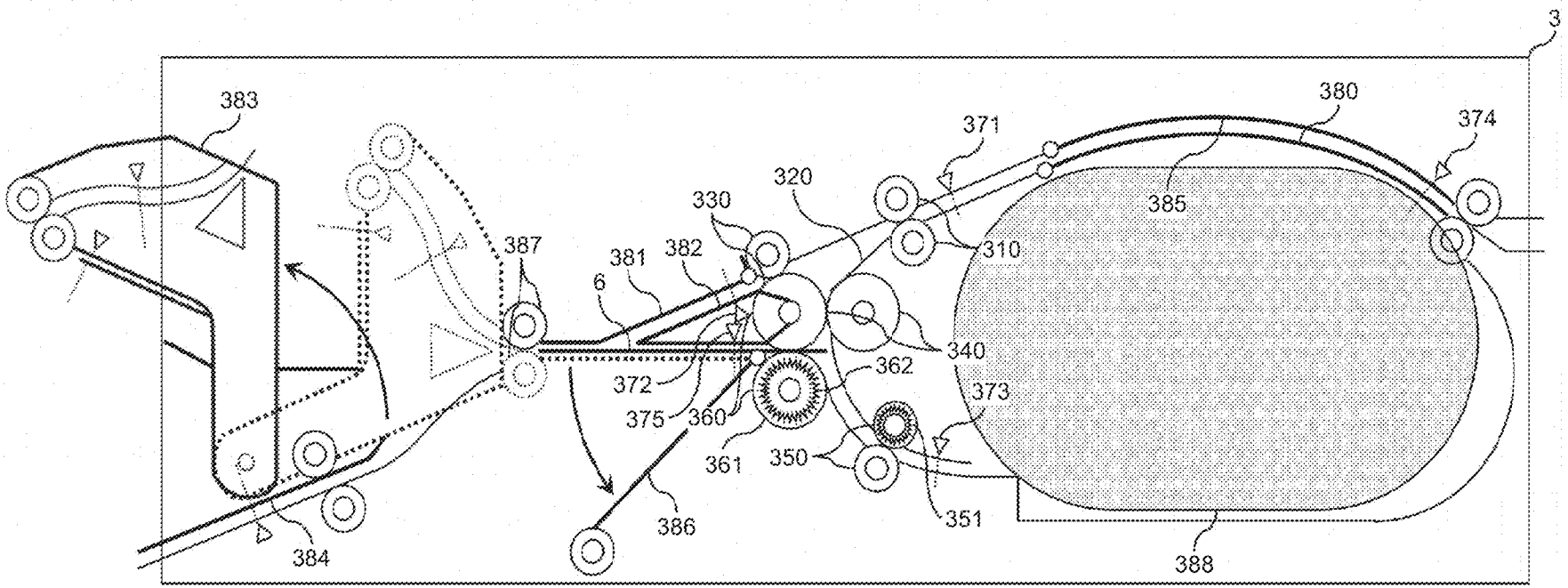
FIG. 29 is a diagram for describing the method by which the user removes the sheet when the conveyance of the sheet is stopped in the folding processing unit according to the embodiment of the present invention.

Next, a description will be made regarding a case where the sheet 6 is stopped between the first folding processing roller pair 360 and the fold-enhancing roller pair 387 as illustrated in FIGS. 28 and 29.

In such a case, the user removes the sheet 6 by opening the folded paper ejection unit 383 in the arrow direction, that is, upwardly, and then, opening the intermediate conveying upper guide plate 381 and the fold-enhancing upper guide plate 382 in the arrow direction, that is, upwardly as illustrated in FIG. 28.

Alternatively, in such a case, the user removes the sheet 6 by opening the folded paper ejection unit 383 in the arrow direction, that is, upwardly, and then, opening the fold-enhancing lower guide plate 386 in the arrow direction, that is, downwardly as illustrated in FIG. 29.

Furthermore, the folding processing unit 3 according to the embodiment is configured such that the intermediate conveying upper guide plate 381 and the fold-enhancing upper guide plate 382 can be opened and closed in a state in which the folded paper ejection unit 383 is opened, but may be configured such that the intermediate conveying upper guide plate 381 and the fold-enhancing upper guide plate 382 can be opened and closed regardless of the opened or closed state of the folded paper ejection unit 383.

In addition, the folding processing unit 3 according to the embodiment is configured such that the fold-enhancing lower guide plate 386 can be opened and closed in a state in which the folded paper ejection unit 383 is opened, but may be configured such that the fold-enhancing lower guide plate 386 can be opened and closed regardless of the opened or closed state of the folded paper ejection unit 383.

It is noted that the folding processing unit 3 according to the embodiment detects that the sheet 6 is stopped between the first folding processing roller pair 360 and the fold-enhancing roller pair 387 by a fifth sheet detection sensor 375.

According to an embodiment, it is possible to easily remove the sheet stopped inside the sheet processing apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a first conveying roller pair configured to convey a sheet;

a second conveying roller pair configured to receive the sheet conveyed by the first conveying roller pair, the second conveying roller pair configured to rotate in a forward and a reverse direction, the second conveying roller pair configured to further convey the sheet received from the first conveying roller pair;

a folding roller pair between the first conveying roller pair and the second conveying roller pair, the folding roller pair configured to form a fold on the sheet; and a rotation device configured to:

cause the second conveying roller pair and the folding roller pair to rotate in response to manual rotation of the rotation device in a first direction, and cause one roller of the folding roller pair to idle in response to manual rotation of the rotation device in a second direction opposite the first direction.

2. The sheet processing apparatus according to claim 1, wherein the sheet is ejected from the folding roller pair in a direction in which the sheet is conveyed by the folding roller pair, by continuing to manually rotate the rotation device in the first direction while the sheet is held by at least the second conveying roller pair.

3. The sheet processing apparatus according to claim 2, wherein, in response to the manual rotation of the rotation device in the first direction, the sheet is conveyed by the folding roller pair to a space downstream in the direction in which the sheet is conveyed by the folding roller pair, the space being a space for removing the sheet from the sheet processing apparatus.

4. The sheet processing apparatus according to claim 1, wherein the rotation device includes a rotation knob for rotating the rotation device, the rotation knob being attached to the one roller of the folding roller pair.

5. The sheet processing apparatus according to claim 1, wherein one roller of the second conveying roller pair and the one roller of the folding roller pair is a common roller shared between the second conveying roller pair and the folding roller pair.

6. The sheet processing apparatus according to claim 5, further comprising:

a driving source configured to transmit a first driving force to the second conveying roller pair via a first drive transmission path, wherein the rotation device is configured to rotate the common roller by transmitting a rotational force thereto via a second drive transmission path different from the first drive transmission path, in response to the manual rotation of the rotation device in the first direction.

7. The sheet processing apparatus according to claim 6, wherein the second drive transmission path includes a rotation shaft of the common roller.

8. An image forming system comprising:

an image forming device configured to form an image on a sheet; and the sheet processing apparatus according to claim 1, the sheet processing apparatus being above the imaging forming device.

9. An image forming system comprising:

an image forming device configured to form an image on a sheet; and the sheet processing apparatus according to claim 1, the sheet processing apparatus being adjacent to the image forming device along a horizontal direction.

10. The sheet processing apparatus according to claim 1, wherein the rotation device is connected to a shaft of the one roller of the folding roller pair.

11. The sheet processing apparatus according to claim 1, wherein the rotation device is configured to:

transmit a rotational force to the one roller of the folding roller pair to rotate the one roller of the folding roller pair in response to rotation of the rotation device in the first direction, and not transmit the rotational force to the one roller of the folding roller pair in response to rotation of the rotation device in the second direction opposite the first direction.

12. The sheet processing apparatus according to claim 1, wherein the rotation device is configured to rotate the second conveying roller pair and the folding roller pair in response to the manual rotation of the rotation device by a user.

13. The sheet processing apparatus according to claim 1, wherein the folding roller pair is configured to form the fold on the sheet in response to the manual rotation of the rotation device in the first direction while the sheet is held by at least the second conveying roller pair.

14. The sheeting processing apparatus according to claim 1, wherein the rotation device is configured so that when a cover of the sheet processing apparatus is opened, a user can directly contact the rotation device.

15. The sheet processing apparatus according to claim 1, further comprising:

a bifurcating claw configured to move between a closed state and an open state based on a mode of the sheet processing apparatus.

16. The sheet processing apparatus according to claim 1, further comprising:

a bifurcating claw configured to guide the sheet to the folding roller pair when forming the fold in the sheet.

17. A sheet processing apparatus comprising:

a first conveying roller pair configured to convey a sheet;

a second conveying roller pair configured to receive the sheet conveyed by the first conveying roller pair, the second conveying roller pair configured to rotate in a forward and a reverse direction, the second conveying roller pair configured to further convey the sheet received from the first conveying roller pair;

a folding roller pair between the first conveying roller pair and the second conveying roller pair, the folding roller pair configured to form a fold on the sheet;

a driving source configured to drive a common roller of the second conveying roller pair and the folding roller pair in a first direction; and a rotation device configured to:

cause the common roller of the second conveying roller pair and the folding roller pair to rotate in response to manual rotation of the rotation device in the first direction, and cause the common roller of the second conveying roller pair and the folding roller pair to idle in response to manual rotation of the rotation device in a second direction opposite the first direction.

* * * * *